United States Patent [19]

Arai et al.

[11] Patent Number: 4,946,769

[45] Date of Patent: Aug. 7, 1990

[54] SILVER HALIDE PHOTOGRAPHIC LIGHT-SENSITIVE MATERIAL AND THE METHOD OF PREPARING THE SAME

[75] Inventors: Takeo Arai, Hachioji; Toshiharu Nagashima, Hino, both of Japan

[73] Assignee: Konica Corporation, Tokyo, Japan

[21] Appl. No.: 271,253

[22] Filed: Nov. 15, 1988

[30] Foreign Application Priority Data

| | | | |
|---|---|---|---|
| Nov. 16, 1987 | [JP] | Japan | 62-289030 |
| Nov. 17, 1987 | [JP] | Japan | 62-290108 |
| Jul. 13, 1988 | [JP] | Japan | 63-174059 |

[51] Int. Cl.[5] ..... G03C 1/015

[52] U.S. Cl. ..... 430/539; 430/349; 430/640; 430/536; 430/963; 430/935

[58] Field of Search ..... 430/539, 349, 963, 640, 430/935, 536

[56] References Cited

U.S. PATENT DOCUMENTS

| | | | |
|---|---|---|---|
| 2,620,285 | 12/1952 | Chester | 430/935 |
| 4,233,400 | 11/1980 | Fujwhara et al. | 430/264 |
| 4,551,412 | 11/1985 | Ogawa et al. | 430/264 |

FOREIGN PATENT DOCUMENTS

| | | | |
|---|---|---|---|
| 0248390 | 12/1987 | European Pat. Off. | 430/935 |
| 0267019 | 5/1988 | European Pat. Off. | 430/935 |

*Primary Examiner*—Paul R. Michl
*Assistant Examiner*—Tho/l Chea
*Attorney, Agent, or Firm*—Finnegan, Henderson, Farabow, Garrett and Dunner

[57] ABSTRACT

A silver halide photographic light-sensitive material, and a method of preparing the same and a method of image forming using the same photographic material. The photographic material comprises a support bearing, on one side thereof, a layer containing a light-sensitive silver halide emulsion comprised of silver halide grains having an average size of from 0.05 μm to 0.3 μm and gelatin and, on the other side thereof, a non-light-sensitive layer containing gelatin and at least one of the emulsion layer and the non-light-sensitive layer is brought into contact with air having a temperature of from 35° C. to 80° C. or relative humidity of from 5% to 25% for a period not shorter than 5 seconds to not longer than one minute, within 5 minutes from the point of time when the average surface temperature of said layer is raised up to a temperature 1° C. lower than the average temperature of atmospheric are for drying said layer in the step where the said layer is coated on said support and is cooled as to be gelled and dried. The photographic material is processed for a time within the range of from 20 seconds to 60 seconds.

8 Claims, 1 Drawing Sheet

SILVER HALIDE PHOTOGRAPHIC LIGHT-SENSITIVE MATERIAL AND THE METHOD OF PREPARING THE SAME

FIELD OF THE INVENTION

This invention relates to a silver halide photographic light-sensitive material, a method of preparing the same and a method of forming an image by making use of the same and, more particularly, to a graphic arts light-sensitive material excellent in dimensional stability, hard contrast characteristics and rapid processing aptitude.

BACKGROUND OF THE INVENTION

In recent years, the consumption of silver halide photographic light-sensitive materials is being increased year by year. The number of processing silver halide photographic light-sensitive materials are accordingly getting increased, so that there have been demanded for making processing time more rapid, in other words, for increasing the number of processing more within a fixed time.

In graphic arts fields, there is also the same tendency. To be more concrete, now that real-time information and the frequency thereof are rapidly increased, it is required also in graphic arts field not only to complete an allotted work within a shorter time but also to do more jobs. To satisfy the above-mentioned demands of the graphic arts industry, it is required to simplify printing steps and, at the same time, to process each graphic arts film more rapidly.

To shorten the processing time comprising the time required for the processing steps such as those of develoing, fixing, washing and drying, one of the answers is to increase the transport speeds through the steps. However, in the case of processing a film with a roller transport type automatic processor and when a roller transport speed is so accelerated as to shorten the film processing time, there will raise such a trouble that the drying step is not satisfactorily performed, because the drying time is too short. As for the methods for processing films in a short time, there are some methods, namely, one of the methods is to raise a temperature in the course of drying films in an automatic processor, another method is to increase the flow rate of the air coming into contact with a silver halide photographic light-sensitive material, and a further method is to reduce a gelatin content of a light-sensitive material. When drying films in the above-mentioned methods, there will cause such a serious defect that the length of a processed photographic image will become longer than that before it is processed. This defect is so-called a dimensional stability difference between pre-processing and post-processing dimensions. Particularly, in the fields of graphic arts handling color printing, there will cause the troubles such as that the plate dimensions of four colors, yellow, mgenta, cyan and black, will not be coincident with each other. It may be considered that these defects may be derived from the change of the silver halide emulsion of a silver halide photographic light-sensitive material into silver atoms or the elution of the emulsion from the light-sensitive material and the hysteresis of gelatin.

Besides the above-mentioned troubles, another problem will result from increasing the concentration of a sulfur-containing salt in a processed film so as to change the color of the processed film into yellow during storage, because the fixing and washing time are shortened.

A further problem will result from making a density lower even if raising the development activity of a developer and the temperature thereof so as to adjust the sensitivity to the original, because the development time is shortened.

As for the means for solving these problems, there may be a means that the grain sizes of silver halide of a light-sensitive material are made smaller. However, a problem will result from remarkably deteriorating the aforementioned dimensional stability difference between pre-processed and post-processed films, when the grain sizes are made smaller to a certain extent.

As described above, a superrapid processing has been demanded. The term, a 'superrapid processing' stated herein means a process in which the whole period of time from inserting the leading edge of a film into an automatic processor until the leading edge of the film comes out from a drying section of the processor through a developing tank, a cross-over section, a fixing tank, a cross-over section, a washing tank, a cross-over section and a drying section, respectively, (in other words, the whole period of time means a quotinent of the total length (in meter) of a processing line divided by a line transport speed (in meter/second), the period is within the range of from 20 sec. to 60 sec. The reason why the period of cross-over should be included therein is that a gelatin layer being transported through a cross-over section is pregnant with the liquid used in the preceeding processing step and thereby the processing may be regarded as is still being substantially progressed, of which has been well known in the art.

In addition to the above, there are the methods for inhibiting the dimensional change of light-sensitive materials, by adding a hydrophilic colloidal layer with such a latex as those disclosed in, for example, Japanese Patent Examined Publication Nos. 39-17702 (1964), 39-24142 (1964), 43-13482 (1968) and 45-5331 (1970): U.S. Pat. Nos. 2,376,005, 2,763,625, 2,772,166, 2,852,386, 2,853,457, 3,397,988, 3,411,911 and 3,411,912; and so forth. They are, however, not only unsatisfactory to display any effect, but also have the defect that an image density lowering is further multiplied after processed in the aforementioned superrapid processing.

Meanwhile, when processing a silver halide photographic light-sensitive material with a roller-transport type automatic processor, the density of a photograph and the dot quality thereof will be deteriorated when accelerating a roller-transport speed and shortening a developing time. To compensating these deteriorations, there are a method of increasing the activity of a developer and another method of raising the temperature of a developer. However, these methods generally have the defects that fog will be increased, dots will be coarse-grained or faded out in edge portions. Taking a high quality finishing having been recently demanded by the graphic arts field into consideration, such a simple high temperature rapid process as above-mentioned is not preferable.

Accordingly, it has been demanded to provide a super-rapid processable photographic light-sensitive material having both of a highly finished quality and a high dimensional stability.

SUMMARY OF THE INVENTION

It is an object of the invention to provide a silver halide photographic light-sensitive material without damaging any photographic characteristics and having an excellent dimensional stability both before and after processing even when the light-sensitive material is processed and dried with, for example, an automatic processor, and to provide a method for preparing the light-sensitive material.

Another object of the invention is to provide a silver halide photographic light-sensitive material capable of solving the aforementioned problems derived from the conventional art even when carrying out the above-mentioned super-rapid process, for example, which takes a period of time from 20 sec. to 60 sec. for the whole processing step, and having excellent operational speed, dimensional stability, reverse plate making and dot quality as well as few fogginess, and also to provide the method for preparing the same.

These and other objects of the invention will become apparent from the following detailed description.

The objects of the invention can be achieved with a silver halide photographic light-sensitive material and the method of preparing the same comprising a support bearing, on one side thereof, at least one light-sensitive silver halide emulsion layer containing a silver halide having an average grain size of from 0.05 $\mu$m to 0.3$\mu$m and gelatin and, on the other side thereof, at least one non-light-sensitive layer containing gelatin, wherein the light-sensitive material is prepared in the manner that at least one coated layer is provided to either one side of the light-sensitive material and the coated layer is brought into contact with the air having a temperature of from 35° C. to 80° C. for a period of from not shorter than 5 sec. to not longer than one minute, within 5 minutes from the point of time when the average surface temperature of the coated layer is raised up to a temperature 1° C. lower than the average temperature of atmospheric air for drying gelatin in the step where the gelatin is so cooled as to be gelled and dried.

The above-mentioned objects can be achieved with a silver halide photographic light-sensitive material and the method for preparing the same which is brought into contact with the air having a relative humidity of from 25% to 5% for a period of from not shorter than 5 sec. to not longer than 1 min., instead of the aforementioned air having a temperature of from 35° C. to 80° C. applied for the same period of time.

The effects of the invention can be displayed more excellently when the light-sensitive material of the invention is brought into contact with the air substantially having a dew-point of not higher than 16° C. in the course of the steps from the point of time when the coating and drying steps are completed that is the point of time when completing the coating and drying processes for both of sides of the light-sensitive material to the point of time when the light-sensitive material is completely packaged.

In addition to the above, a silver halide photographic light-sensitive material having a polymer latex content of from 0.1 g/m$^2$ to 10 g/m$^2$ in at least one of the hydrophilic colloidal layers provided to at least one side of the support, such light-sensitive material can be further improved on the pre-processing and post-processing dimensional stabilities by applying the above-mentioned drying process.

In this patent specification, the words, 'dimensional stability', means difference of dimensions between a pre-processing and post-processing.

DETAILED DESCRIPTION OF THE INVENTION

Figure 1:
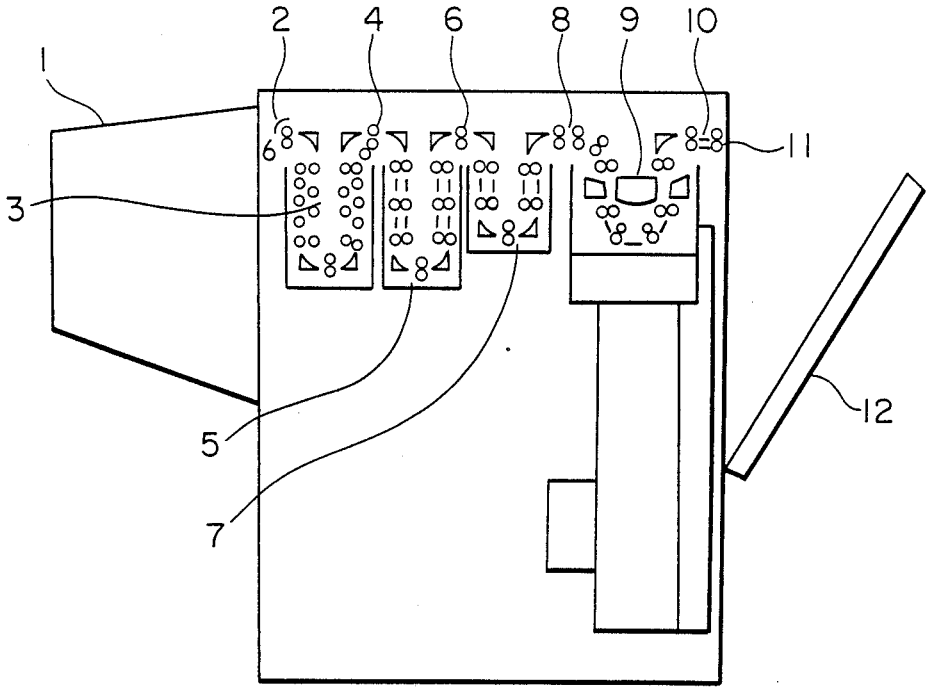
FIG. 1 is a cross-section of a film transport mechanism.

Coating and drying conditions for preparing a light-sensitive material are usually applied in such a manner that a coating solution comprising a gelatin composition is coated over to a support and is then generally so cooled down as to be solidified in the air having a low dry-bulb temperature of from −10° to 15° C. and the resulting coated layer is then dried by raising the temperature. However, such a high temperature drying as mentioned above aims at making a drying rate faster and, therefore, at the point of time when the drying is completed, the air temperature having been contacted with the coated layer is usually restored to an ordinary temperature.

In the invention, a silver halide photographic light-sensitive material is brought into contact with the air having a temperature of from 35° C. to 80° C. for a period of from not shorter than 5 sec. to not longer than 1 min. within 5 min. from the point of time when the average temperature of the coated layer surface is raised up to a temperature 1° C. lower than the average temperature of the atmospheric air for drying the coated layer in the preparating steps where at least either one of the coated layers is coated and the gelatin of the layer is so cooled down as to be gelled and dried. The expression, 'the point of time when the average temperature of a coated layer surface is raised up to a temperature 1° C. lower than that of the air coming into contact with the layer' stated herein corresponds to the point of time when the moisture content of a gelatin composition is within the range of from 60% to 20%, that may be regarded as the point of time when the drying step may substantially be completed. In other words, a light-sensitive material is brought into contact with the air having a temperature of from not lower than 35° C. to not higher than 80° C. for a period from 5 sec. to not longer than 1 min from the above-mentioned point of time. This fact results in excellently improving a dimensional stability, assuming that a synergetic effect of both silver halide grain sizes and this fact may be displayed. The contact of a light-sensitive material with the above-mentioned air having a temperature of from not lower than 35° C. to not higher than 80° C. corresponds to the contact of the light-sensitive material with the air having a relative humidity of from 25% to 5%. The same effects can also be enjoyed in the invention in which a light-sensitive material is brought into contact with the air having a relative humidity of from 25% to 5%.

This kind of effects cannot be displayed when processing a light-sensitive material in the range of a moisture content of not less than 60% while bringing the light-sensitive material into contact with the air having a temperature within the range of from 35° C. to 80° C. Further, in this kind of processes, it has been well known in the art that many pin-holes are produced by moving a matting agent from a surface layer into gelatin. In the invention, it is hard to cause this kind of troubles.

In this specification, the point of time when a light-sensitive material is brought into contact with the air having a temperature of from 35° C. to 80° C. or the air such as dried air blow having a relative humidity of from 25% to 1% in the above-mentioned process, such a point of time is hereby defined as the point of time when a coating and drying process is completed. In a coating and drying process where the drying requirements of the invention is not carried out, the above-mentioned point of time is defined as the point of time when a coated light-sensitive material passed through a drying zone.

The methods for adjusting a relative humidity to be within the range of from 25% to 5% include, for example, a method of raising a temperature of the air coming into contact with a light-sensitive material, another method of lowering an absolute moisture content of the air coming into contact therewith by making use of a dehumidifier and a combination method of the above-mentioned two methods.

From the results of a further study, the inventors have found that the dimensional stabilities relating the processing can be improved more than before when applying the drying requirements of the invention to a silver halide photographic light-sensitive material containing polymer latex in an amount of from 0.1 $g/m^2$ to 10 $g/m^2$ in at least one hydrophilic colloidal layer arranged to at least one side of a support. Such a silver halide photographic light-sensitive material containing the above-mentioned polymer latex has showed an excellent surface property without causing any cracks on the surface of the light-sensitive material, even when it is exposed to the air having a very high temperature and a very low humidity in the drying conditions.

It is effective to bringing a light-sensitive material into contact with the air relating to the invention at the point of time when completing a drying process. For example, when coating and drying each coated layer provided on both sides of a support one after another, it is effective when at least either one of the coated layers is treated at the above-mentioned high temperature in its coating and drying processes. It is more preferable that the both layers are treated at a high temperature in their coating and drying processes.

When shipping thus manufacture silver halide photographic light-sensitive materials as the merchandise, the effects of the invention can effectively be displayed particularly when carrying out the steps from the completion of coating and drying both sides of the light-sensitive material to the completion of packaging it in the circumstances where a dew-point temperature is not higher than 16° C.

Another object of the invention can be achieved when a silver halide photographic light-sensitive material has a gamma ($\gamma$) of not lower than 6 specified with respect to a density of from 0.3 to 3.0, in the aforementioned drying requirements.

From the results having been obtained by the repeated studies, the inventors have further found that, in a photographic light-sensitive material having hard contrast photographic characteristics such as a $\gamma$ value of not lower than 6 specified with respect to a density of from 0.3 to 3.0, such a light-sensitive material can display a furthermore excellent dimensional stability as it still remains excellent in property in reproduction of line width in multiple layer contact work and dot quality as well as low in fogginess. The synergistic effects of the photographic characteristics and the dimensional stabilities have not so far been known at all in the conventional art.

Now, the invention will be described in further detail.

In the invention, the above expression, 'the air for drying a light-sensitive material', hereby means the air with which the light-sensitive material is brought into contact and so supplied as to blow directly on the light-sensitive material for the purpose of drying it or adjusting its moisture content. Thus defined air does not mean the air present in the space between the surfaces of rolled light-sensitive material which has been coated and dried or between the surfaces of light-sensitive materials which have been cut into a desired size and piled up.

The expression, 'the steps from the point of time when completing a coating and drying process to the point of time when completing a packaging' stated herein include such a step as those of taking up, cutting and packaging a light-sensitive material and, sometimes, those steps include, such a process as those of storing and transferring it. In the specification, the expression, 'the air to be brought into contact with', stated herein means 'the air being brought into contact with a light-sensitive material in such a state that the light-sensitive material comes into contact with nothing but the air. In most cases for transferring a light-sensitive material, it is taken up to be in the rolled form, i.e., in a bulk, or it is cut into a desired size and then piled up. In the case of a bulk, for example, it may be considered that the air in the circumstances where the bulk is placed does not substantially come into contact with the portion of the bulk where a light-sensitive material comes into contact on the both sides thereof with other light-sensitive materials.

In other words, for example, in the case where, after completing the coating and drying process of the invention, a light-sensitive material is brought into contact with the air having a dew point of not higher than 16° C. and is then taken up to be in the form of a roll, and the resulting bulk roll is transferred through the air having a dew point of not higher than 17° C. and then cut into a desired size and packaged while coming into contact again with the air having a dew point of not higher than 16° C., such a case shall also be included in the preferred embodiments of the invention.

In the invention, on one side of a support, light-sensitive silver halide grains having an average grain size of from 0.05 $\mu$m to 0.35 m are used. The term, an 'average grain size', herein means an average diameter of the grains in the case of globular-shaped grains and an average diameter of the circular images having the same areas as those of the images projected from the grains in the case of the other shaped grains than the globular-shaped ones.

It is preferable that not less than 60% of the total number of grains should have a grain size within the range of plus or minus 10% of an average grain size.

The silver halide emulsions applicable to the invention, hereinafter sometimes called the silver halide emulsions or simply the emulsions, are allowed to use any of silver halides which may be used in an ordinary types of silver halide emulsions, such as silver bromide, silver iodobromide, silver iodochloride, silver chlorobromide, silver chloride and so forth. Among them, it is preferable to use silver chlorobromide containing silver chloride in a proportion of not less than 60 mol % to serve as a negative type silver halide emulsion and to use silver chlorobromide, silver bromide or silver iodobromide each containing silver bromide in a proportion of not less than 10 mol % to serve as a positive type silver halide emulsion.

The silver halide grains applicable to the silver halide emulsion may be any of those prepared in an acidifying method, a neutralizing method, an ammoniacal method or the like methods. Those grains may be grown up at a time or may be grown up after preparing seed grains. The processes of preparing the seed grains and the processes of growing them may be either the same with or the different from each other.

The silver halide emulsion may also be prepared by mixing silver halide ions and silver ions together at the same time or by mixing either one of the ions in a liquid containing the other. In addition, the emulsion may be prepared by adding halide ions and silver ions gradually and at the same time while controlling the pH and pAg of a mixture solution, taking the critical growth rate of silver halide crystals into consideration. According to this preparation process, silver halide grains regular in crystal form and nearly uniform in grain size may be prepared. After growing the grains, the halide compositions of the grains may be varied in a conversion method.

When preparing silver halide emulsions, if required, it is allowed to control the grain size, grain configuration, grain distribution and grain growth rate each of the silver halide grains by making use of a silver halide solvent.

Silver halide solvents include, for example, ammonia, thioether, thiourea, thiourea derivatives such as quadrisubstituted thiourea, imidazole derivatives. For the details of thioether, U.S. Pat. Nos. 3,271,157, 3,790,387, 3,574,628 and so forth.

Such a solvent may be used in a proportion of a reactant solution of from $10^{-3}$ to 1.0 wt % and, preferably, from $10^{-2}$ to $10^{-1}$ wt % in the case of other solvents than ammonia, and any amount may be used in the case of ammonia.

The silver halide grains applicable to the silver halide emulsions are allowed to be added, in the courses of forming the grains and/or growing them, with metal ions by making use of at least one kind of metal salts selected from a group consisting of the salts of cadmium, zinc, lead, thallium, iridium including the complex salts thereof, rhodium including the complex salts thereof and iron and the complex salts thereof, so as to contain the metal element of the above-given metal salts in the inside and/or surface of each grains. Particularly, it is preferable to contain a water-soluble rhodium salts therein. A reduction sensitization nucleus may be provided to the inside and/or surface of a grain by making an atmosphere appropriately reducible. When adding a water-soluble rhodium salt, it should be preferable to add in an amount of from $1\times10^{-7}$ to $1\times10^{-4}$ mol per mol of AgX.

After completing the growth of silver halide grains, unnecessary soluble salts may be removed from the silver halide emulsions or may be allowed to remain contained therein. When removing the salts, it is allowed to follow the removing method described in, for example. Research Disclosure, No. 17643.

The silver halide grains applicable to the silver halide emulsions may be either those having a uniform silver halide composition distribution therein or core/shell type grains having the silver halide compositions which are different between one inside the grains and the other in the surface layer thereof.

The silver halide grains applicable to the silver halide emulsions may be either those capable of forming a latent image on the surfaces of the grains or those capable of forming it inside the grains.

The silver halide grains applicable to the silver halide emulsions ar allowed to have either regular crystal forms such as a cube, an octahedron and a tetradecahedron or irregular forms such as a globular-form and tabular-form. In these grains, any ratios of {100} face to {111} face may be used. Those grains may be not only in the complexed crystal forms but in various forms.

In order to serve as the silver halide emulsions, it is allowed to use the mixture of two or more kinds of silver halide emulsions separately prepared.

The silver halide emulsions may be chemically sensitized in any ordinary methods, namely, a sulfur sensitizing method, a selenium sensitizing method, a reduction sensitizing method, a noble-metal sensitizing method in which gold or other noble metals are used, or the like methods, independently or in combination.

It is preferable to sensitize the silver halide emulsions in the sensitizing methods with the sensitizers described in, for example, British patent Nos. 618,061, 1,315,755 and 1,396,696; Japanese Patent Examined Publication No. 44-15748 (1969): U.S. Pat. Nos. 1,574,944, 1,623,499, 1,673,522, 2,278,947, 2,399,083, 2,410,689, 2,419,974, 2,448,060, 2,487,850, 2,518,698, 2,521,926, 2,642,361, 2,694,637, 2,728,668, 2,739,060, 2,743,182, 2,743,183, 2,983,609, 2,983,610, 3,021,215, 3,026,203, 3,297,446, 3,297,447, 3,361,564, 3,411,914, 3,554,757, 3,565,631, 3,565,633, 3,591,385, 3,656,955, 3,761,267, 3,722,031, 3,857,711, 3,891,446, 3,901,714, 3,904,415, 3,930,867, 3,984,249, 4,054,457 and 4,067,740; Research Disclosure, Nos. 12008, 13452 and 13654; T. H. James, 'The Theory of the Photographic Process', 4th ed., Macmillan 1977, pp. 67–76; and so forth.

The hard contrast photographic characteristics having a $\gamma$ value of 6.0 which is specified with respect to a density of from 0.3 to 3.0, that is one of the preferable embodiments of the invention, may be applied to both of the negative and positive types light-sensitive materials. It is particularly preferable to prepare a negative type of light-sensitive material in such a process that a tetrazolium, hydrazine or polyalkylene oxide compound is contained in at least one of the hydrophilic colloidal layers each containing a light-sensitive silver halide emulsion and/or in the adjacent layers each constituting the negative photographic light-sensitive material. The light-sensitive material is processed with a developer containing hydroquinone only or hydroquinone-phenidone or hydroquinone-metal as developing agent and having a pH of from 10 to 13.

First, the process using a tetrazolium compound will be described. The techniques of applying tetrazolium compounds to a silver halide photographic light-sensitive material are disclosed in, for example, Japanese Patent O.P.I. Publication Nos. 52-18317 (1977), 53-17719 (1978), 53-17720 (1978) and 61-149946 (1986), and so forth. These techniques are hereinafter called the tetrazolium hardening technique.

The concrete examples of the tetrazolium compounds applicable to the invention include the compounds represented by the following Formulas VII-1, VII-2 and VII-3 each given in Japanese Patent O.P.I. Publication No. 62-11253 (1987).

[VII-1]

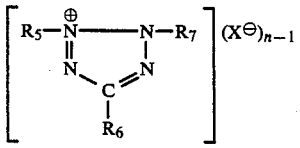

[VII-2]

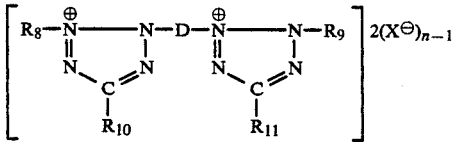

[VII-3]

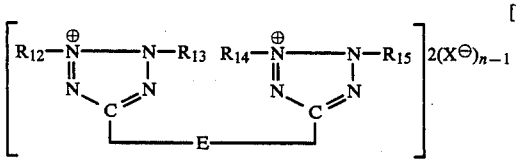

wherein $R_5$, $R_6$, $R_7$, $R_8$, $R_9$, $R_{12}$, $R_{13}$, $R_{14}$ and $R_{15}$ each represent a group selected from the group consisting of such an alkyl group as a group of methyl, ethyl, propyl, dodecyl or the like; an allyl group; such a phenyl group as a group of phenyl, tolyl, hydroxyphenyl, carboxyphenyl, aminophenyl, mercaptophenyl, methoxyphenyl or the like; such a naphthyl group as a group of α-naphthyl, β-naphthyl, hydroxynaphthyl, carboxynaphthyl, aminonaphthyl or the like; and such a heterocyclic group as a group of thiazolyl, benzothiazolyl, oxazolyl, pyrimidinyl, pyridyl or the like; such a group as given above may be a group capable of forming a metal chelate or a complex; $R_6$, $R_{10}$ and $R_{11}$ each represent a group selected from the group consisting of an allyl group, a phenyl group, a naphthyl group, a heterocyclic group, such an alkyl group as a group of methyl, ethyl, propyl, butyl, mercaptomethyl, mercaptoethyl or the like, a hydroxyl group, an alkylphenyl group, an alkoxyphenyl group, a carboxyl group or the salts thereof, such a carboxyalkyl group as a group of methoxycarbonyl or ethoxycarbonyl, such an amino group as a group of amino, ethylamino, anilino or the like, a mercapto group, a nitro group and a hydrogen atom; D represents a divalent aromatic group; E represents a group selected from the group consisting of an alkylene group, an allylene group and an aralalkylene group; X represents an anion: n is an integer of 1 or 2, provided that n is 1 when a compound forms anintramolecular salt..

Next, the typical examples of the cationic components of the tetrazolium compounds applicable to the invention. It is, however, to be understood that the cationic components of the compounds applicable to the invention shall not be limited thereto.

T-1 2-(benzothiazole-2-yl)-3-phenyl-5-dodecyl-2H-tetrazolium

T-2 2,3-diphenyl-5-(4-t-octyloxyphenyl)-2H-tetrazolium

T-3 2,3,5-triphenyl-2H-tetrazolium

T-4 2,3,5-tri(p-carboxyethylphenyl)-2H-tetrazolium

T-5 2-(benzothiazole-2-yl)-3-phenyl-5-(o-chlorphenyl)-2H-tetrazolium

T-6 2,3-diphenyl-5-methyl-2H-tetrazolium

T-7 2,3-diphenyl-5-methyl-2H-tetrazolium

T-8 3-(p-hydroxyphenyl)-5-methyl-2-phenyl-2H-tetrazolium

T-9 2,3-diphenyl-5-ethyl-2H-tetrazolium

T-10 2,3-diphenyl-5-n-hexyl-2H-tetrazolium

T-11 5-cyano-2,3-diphenyl-2H-tetrazolium

T-12 2-(benzothiazole-2-yl)-5-phenyl-3-(4-tolyl)-2H-tetrazolium

T-13 2-(benzothiazole-2-yl)-5-(4-chlorophenyl)-3-(4-nitrophenyl)-2H-tetrazolium

T-14 5-ethoxycarbonyl-2,3-di(3-nitrophenyl)-2H-tetrazolium

T-15 5-acetyl-2,3-di(p-ethoxyphenyl)-2H-tetrazolium

T-16 2,5-diphenyl-3-(p-toryl)-2H-tetrazolium

T-17 2,5-diphenyl-3-(p-iodophenyl)-2H-tetrazolium

T-18 2,3-diphenyl-5-(p-diphenyl)-2H-tetrazolium

T-19 5-(p-bromophenyl)-2-phenyl-3-(2,4,6-trichlorophenyl)-2H-tetrazolium

T-20 3-(p-hydroxyphenyl)-5-(p-nitrophenyl)-2 -phenyl-2H-tetrazolium

T-21 5-(3,4-dimethoxyphenyl)-3-(2-ethoxyphenyl)-2 -(4-methoxyphenyl)-2H-tetrazolium T-22 5-(4-cyanophenyl)-2,3-diphenyl-2H-tetrazolium T-23 3-(p-acetamidophenyl)-2,5-diphenyl-2H-tetrazolium T-24 5-acetyl-2,3-diphenyl-2H-tetrazolium T-25 5-(fur-2-yl)-2,3-diphenyl-2H-tetrazolium T-26 5-(thiophene-2-yl)-2,3-diphenyl-2H-tetrazolium T-27 2,3-diphenyl-5-(pyrido-4-yl)-2H-tetrazolium T-28 2,3-diphenyl-5-(quinol-2-yl)-2H-tetrazolium T-29 2,3-diphenyl-5-(benzotriazole-2-yl)-2H-tetrazolium T 30 2,3-diphenyl-5-nitro-2H-tetrazolium T-31 2,2',3,3'-tetraphenyl-5,5'-1,4-butylene-di-(2H-tetrazolium)

T-32 2,2',3,3'-tetraphenyl-5,5'-p-phenylene-di-(2H-tetrazolium

T-33 2-(4,5-dimethylthiazole-2-yl)-3,5-diphenyl-2H-tetrazolium

T-34 3,5-diphenyl-2-(triazine-2 -yl)2H-tetrazolium)

T-35 2-(benzothiazole-2-yl)-3-(4-methoxyphenyl)-5-phenyl-2H-tetrazolium

T-36 2,3-dimethoxyphenyl-5-phenyl-2H-tetrazolium

T-37 2,3,5-tris(methoxyphenyl)-2H-tetrazolium

T-38 2,3-dimethylphenyl-5-phenyl-2H-tetrazolium

T-39 2,3-hydroxyethyl-5-phenyl-2H-tetrazolium

T-40 2,3-hydroxymethyl-5-phenyl-2H-tetrazolium

T-41 2,3-cyanohydroxyphenyl-5-phenyl-2H-tetrazolium

T-42 2,3-di(p-chlorophenyl)-5-phenyl-2H-tetrazolium

T-43 2,3-di(hydroxyethoxyphenyl)-5-phenyl-2H-tetrazolium

T-44 2,3-di(Z-pyridyl)-5-phenyl-2H-tetrazolium

T-45 2,3,5-tris(2-pyridyl)-2H-tetrazolium

T-46 2,3,5-tris(4-pyridyl)-2H-tetrazolium

In the case where a tetrazolium compound is used as it is not diffusible, a non-diffusible compound obtained by suitably selecting its cationinc and anionic components is to be used.

The anionic components of the tetrazolium compound applicable to the invention include, for example;

Halogen ions such as an ion of chlorine, bromine, iodidine and so forth;

Acid groups of inorganic acids, such as sulfuric acid, nitric acid, perchloric acid and so forth;

Acid groups of organic acids, such as sulfonic acid, carboxylic acid and so forth;

Lower alkylbenzenesulfonic acid anions such as p-toluenesulfonic acid anion and so forth;

Higher alkylbenzenesulfonic acid anions such as p-dodecylbenzenesulfonic acid anion and so forth:

Higher alkyl sulfuric acid ester anions such as laurylsulfate anion and so forth;

Dialkylsulfosuccinate anions such as di2-ethylhexylsulfosuccinate anion and so forth;

Polyetheralcohol sulfuric acid ester anions such as cetyl polyetheroxysulfate anion and so forth;

Higher aliphatic acid anions such as stearic acid anion and so forth; and

Polymers each having an acid group, such as polyacrylic acid anion and so forth.

The non-diffusible tetrazolium compounds relating to the invention can be synthesized by suitably selecting the anionic and cationic components. The compounds relating to the invention thus synthesized include, for example, 2,3,5-triphenyl-2H-tetrazolium-dioctyl succinate sulfonic acid salts and so forth. They are used, in one case, in such a manner that, after dispersing the soluble salts of anion and cation components in gelatin, respectively, the both matters are mixed and then dispersed in a gelatin matrix and, in another case, they are used in such a manner that, after purely synthesizing the crystals of an oxidizing agent, the resulting matter is dissolved in such an appropriate solvent as dimethyl sulfoxide and the resulting solution is then dispersed in a gelatin matrix. If the dispersion could hardly be uniformed, there may also be some instances where a good effect may be obtained in a method that the resulting solution is dispersed to make an emulsion by making use of such a suitable homogenizer as a ultrasonic homogenizer, a Manton-Gaulin homogenizer or the like. It is also allowed to finely disperse the resulting solution in such a high boiling solvent as dioctyl phthalate or the like so as to be protected form and the resulting fine dispersion is dispersed in a hydrophilic colloidal layer.

Next, referring to a method in which a hard contrast negative image is obtained by processing a negative type silver halide photographic light-sensitive material containing a hydrazine derivative that is a specific acylhydrazine compound including, for example, those given in, U.S. Pat. Nos. 4,166,742, 4,168,977, 4,221,857, 4,224,401, 4,243,739, 4,272,606 and 4,311,781, by making use of a solution containing a sulfite preserving agent in an amount of 0.15 mol/liter at a pH of from 11.0 to 12.3, (The above-mentioned method is hereinafter referred to as the hydrazine hard-contrast developing system.) The examples of the hydrazine derivatives applicable to the above-mentioned system include arylhydrazides each having a sulfinic acid residual group bonded to the hydrozo portion thereof disclosed in U.S. Pat. No. 4,478,928 and, besides, the compounds each represented by the following Formula III.

Formula III $R_2$-NHNH-G-$R_2$ wherein $R_1$ represents an aliphatic group or an aromatic group; $R_2$ represents a hydrogen atom, a substituted or non-substituted alkyl group, a substituted or non-substituted aryl group, a substituted or non-substituted alkoxy group, or a substituted or non-substituted aryloxy group: G represents a carbonyl group, a sulfonyl group, a sulfoxy group, a phosphoryl group, or an N-substituted or non-substituted iminomethylene group. The hydrazine derivatives represented by the above-given Formula III are disclosed in Japanese Patent O.P.I. Publication No. 62-210458 (1987), and the exemplified compounds given in the same publication may also be applicable to this invention.

In the invention, a hydrazine derivative should be contained in an amount within the range of, preferably, from $1\times10^{-6}$ mol to $5\times10^{-2}$ mol per mol of a silver halide used and, more preferably, from $1\times10^{-5}$ mol to $2\times10^{-2}$ mol.

In the invention, when containing a hydrazine derivative in a photographic light-sensitive material, it may be added in the form of an aqueous solution if it is water-soluble. If the hydrazine derivative is water-insoluble, it may be added in either a silver halide emulsion solution or a hydrophilic colloidal solution after it is made be in the form of an organic solvent solution capable of being soluble in water, including, for example, those comprising alcohols such as methanol or ethanol, esters such as ethyl acetate, ketones such as acetone or the like.

In the invention, the hydrazine derivative may be used either independently or in combination.

It has been known to apply a method using a polyalkylene oxide compound to lith-type photographic light-sensitive materials. Besides the above, there is also a well-known system for obtaining a hard contrast image in sumch a manner that the lith-type silver halide light-sensitive material is processed with a hydroquinone developer, namely, a developer containing a nitroindazole type compound and having a considerably high sulfurous acid ion concentration of not lower than 0.2 mol per liter and a high pH of not lower than 10.5. This system is disclosed in Japanese Patent O.P.I. Publication No. 58-190943 (1983) and is hereinafter called a rapid lith processing technique.

Next, the polyalkylene oxide compounds applicable to the rapid lith processing technique will be described below.

The polyalkylene oxide compounds applicable to the invention include an alkylene oxide having 2 to 4 carbon atoms such as ethylene oxide, propylene-1,2-oxide, butylene-1,2oxide and, preferably, a condensation product of polyalkylene oxide comprising at least 10 ethylene oxide units and a compound having at least one active hydrogen atom such as water, an aliphatic alcohol, an aromatic alcohol, a fatty acid, an organic amine, a hexitol derivative and the like, or a block polymer comprising two or more kinds of polyalkylene oxides. To be more concrete, the polyalkylene oxide compounds may be used in the following forms.

Polyalkylene glycols,
Polyalkylene glycol alkyl ethers,
Polyalkylene glycol aryl ethers,
Polyalkylene glycol (alkylaryl) esters,
Polyalkylene glycol esters,
Polyalkylene glycol aliphatic acid amides,
Polyalkylene glycol amines,
Polyalkylene glycol block copolymers,
Polyalkylene glycol graft polymers, etc.

It shall not always be limited to contain only one of the above-mentioned polyalkylene oxides in a molecule, but two or more of them may also be contained therein. In the latter case, it is allowed that the individual polyalkylene oxide chains each have less than 10 alkylene oxide units, provided however that the total number of alkylene oxide units contained in a molecule should be ten. In the case where a molecule has two or more polyalkylene oxides, it is allowed that the alkylene oxides may have the different alkylene oxide units from each other units, such as a combination of an ethylene oxide and a propylene oxide. The polyalkylene oxide compounds applicable to the invention preferably contain the number of the alkylene oxide units of from not less than 14 to 100 units.

The concrete examples of the polyalkylene oxide compounds applicable to the invention include the following compounds.

Examples of polyalkylene oxide compounds $HO(CH_2CH_2O)_9H$ 1

$C_{12}H_{25}O(CH_2CH_2O)_{15}H$ 2

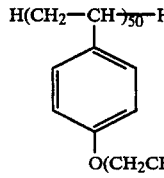

3

$C_8H_{17}CH{=}CHC_8H_{16}O_8(CH_2CH_2O)_{15}H$ 4

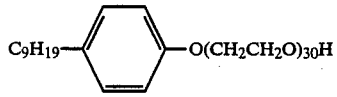

5

$C_{11}H_{23}COO(CH_2CH_2O)_{80}H$ 6

$C_{11}H_{23}CONH(CH_2CH_2O)_{13}H$ 7

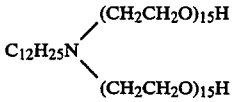

8

$C_{14}H_{29}N(CH_2)(CH_2CH_2O)_{24}H$ 9

$H(CH_2CH_2O)_a(CH(CH_3)CH_2O)_b(CH_2CH_2O)_cH$ 10 a + b + c = 50 b:a + c = 10:9

In the invention, the polyalkylene oxide compounds may be added in an amount of, preferably, from $10^{-4}$ to $10^{-1}$ g per mol of Ag and, more preferably, from $10^{-3}$ to $10^{-2}$ g per mol of Ag.

The silver halide emulsions applicable to the light-sensitive materials relating to the invention may be optically sensitized to a desired wavelength range by making use of dyes which are well-known in the photographic art as are so-called sensitizing dyes. Such sensitizing dyes may be used independently or in combination. An emulsion is allowed to contain not only the sensitizing dyes but also a super-sensitizer that is a dye having no spectral sensitizing effect in itself or a compound substantially incapable of absorbing visible rays of light but capable of enhancing the sensitizing effect of the sensitizing dyes.

As for the sensitizing dyes, those of cyanine, merocyanine, conjugated cyanine, conjugated merocyanine, holopolar cyanine, hemicyanine, styryl or hemioxanol are used.

The particularly useful dyes include, for example, those of cyanine, merocyanine, conjugated cyanine, conjugated merocyanine, holopolar cyanine, styryl and hemioxanol. These dyes may be applied with any nuclei which are usually applied to cyanine dyes, to serve as the basic heterocyclic nuclei. These heterocyclic nuclei include, for example, those of pyrroline, oxazoline, thiazoline, pyrrole, oxazole, thiazole, selenazole, imidazole, tetrazole and pyridine, and nuclei each having an alicyclic hydrocarbon ring being held molten into the aforegiven nuclei, such as those of indolenine, benzindolenine, indole, benzoxazole, naphthoxazole, benzothiazole, naphthothiazole, benzoselenazole, benzimidazole, quinoline or the like. These nuclei may be substituted on carbon atoms.

The above-given merocyanine or conjugated halocyanine dyes may be applied with such a 5- or 6-membered heterocyclic nucleus as those of pyrazoline-5-one, thiohydantoine, 2-thioxazolidine-2,4-dione, thiazolidine-2,4-dione, rhodanine, thiobarbituric acid or the like, to serve as the nuclei having a ketomethylene structure.

The sensitizing dyes usefully applicable to a blue light-sensitive silver halide emulsion layer include, for example, those described in West German Patent No. 929,080; U.S. Pat. Nos. 2,231,658, 2,483,748, 2,503,776, 2,519,001, 2,912,329, 2,656,959, 3,672,897, 3,694,217, 4,025,349 and 4,046,572; British Patent No. 1,242,588; Japanese patent Examine Publication Nos. 44-14030 (1969) and 52-24844 (1977); and so forth.

The sensitizing dyes usefully applicable to a green light-sensitive silver halide emulsion layer include, typically, the dyes of cyanine, merocyanine or conjugated cyanine, such as those described in, for example, U.S. Pat. Nos. 1,939,201, 2,072,908, 2,739,149 and 2,945,763; British Patent No. 505,979; and so forth. The sensitizing dyes usefully applicable to a red light-sensitive silver halide emulsion layer include, typically, the dyes of cyanine, merocyanine or cinjugated cyanine, such as those described in, for example, U.S. Pat. Nos. 2,269,234, 2,270,378, 2,442,710, 2,454,629 and 2,776,280; and so forth. It is, further, allowed to usefully apply the dyes of cyanine or conjugated cyanine, such as those described in, for example, U.S. Pat. Nos. 2,213,995, 2,493,748 and 2,519,001; West German Patent No. 929,080; and so forth, to the green or red light-sensitive silver halide emulsion layers.

These sensitizing dyes may be used either independently or in combination. Particularly, such a combination thereof are often used for performing a super-sensitization. The typical examples thereof are given in, for example, Japanese Patent Examined Publication Nos. 43-4932 (1968), 43-4933 (1968), 43-4936 (1968), 44-32753 (1969), 45-25831 (1970), 45-26474 (1970), 46-11627 (1971), 46-18107 (1971), 47-8741 (1972), 47-11114 (1972), 47-25379 (1972), 47-37443 (1972), 48-28293 (1973), 48-38406 (1973), 48-38407 (1973), 48-38408 (1973), 48-41203 (1973), 48-41204 (1973), 49-6207 (1974), 5-40662 (1975), 53-12375 (1978), 54-34535 (1979) and 55-1569 (1980); Japanese Patent O.P.I. Publication Nos. 50-33220 (1975), 50-33828 (1975), 50-38526 (1975), 51-107127 (1976), 51-115820 (1976), 51-135528 (1976), 51-151527 (1976), 52-23931 (1977), 52-51932 (1977), 52-104916 (1977), 52-104917 (1977), 52-109925 (1977), 52-110618 (1977), 54-80118 (1979), 56-25628 (1981), 57-1483 (1982), 58-10753 (1983), 58-91445 (1983), 58-153926 (1983), 59-114533 (1984), 59-116645 (1984) and 59-116647 (1984); and U.S. Pat. Nos. 2,688,545, 2,977,229, 3,397,060, 3,506,443, 3,578,447, 3,672,898, 3,679,428, 3,796,301, 3,814,609 and 3,837,862, The substances which are to be used together with the above-mentioned sensitizing dye so as to display a super-sensitizing effect, i.e., the dyes having no spectral sensitizing effect in themselves or the substances substantially incapable of absorbing visible rays of light, include, for example, aromatic organic acid formaldehyde condensation products such as those described in U.S. Pat. No. 3,473,510; cadmium salts; azaindene compounds: aminostilbene compounds each substituted with a nitrogen-containing heterocyclic group, such as those described in U.S. Pat. Nos. 2,933,390 and 3,635,721; and so forth. The combinations such as those described in U.S. Pat. Nos. 3,615,613, 3,615,641, 3,617,295 and 3,635,721 are particularly useful.

For the purposes of preventing fog or keeping photographic characteristics stable in the courses of manufacturing, storing or photographically processing a light-sensitive material, the silver halide emulsions applicable to the invention are allowed to be added with the compounds which are well-known as an antifoggant or a stabilizer in the photographic art, in the course of a chemical ripening step, at the point of time when completing the chemical ripening process and/or after the completion thereof, but before the silver halide emulsion are coated.

Some examples of the antifoggants and stabilizers may be given as follows: Azaindenes including pentazaindenes such as those described in U.S. Pat. Nos. 2,713,541, 2,743,180 and 2,743,181, tetrazaindenes such as those described in U.S. Pat. Nos. 2,716,062, 2,444,607, 2,444,605, 2,756,147, 2,835,581 and 2,852,375, and Research Disclosure No. 14851, triazaindenes such as those described in U.S. Pat. No. 2,772,164, polymerized azaindenes such as thos described in Japanese Patent O.P.I. Publication No. 57-211142 (1982), and so forth; quaternary onium salts including thiazolium salts such as those described in U.S. Pat. Nos. 2,131,038, 3,342,596 and 3,954,478, pyrylium salts such as those described in U.S. Pat. No. 3,148,067, phosphonium salts such as those described in Japanese Patent Examined substituted heterocyclic compounds including mercaptotetrazoles, mercaptotriazoles and mercaptodiazoles such as those described in U.S. Pat. Nos. 2,403,927, 3,266,897 and 3,708,303, and Japanese Patent O.P.I. Publication Nos. 55-135835 (1980) and 59-71047 (1984), mercaptothiazoles such as those described in U.S. Pat. No. 2,824,001, mercaptobenzthiazoles and mercaptobenzimidazoles such as those described in U.S. Pat. No. 3,937,987, mercaptoxadiazoles such as those described in U.S. Pat. No. 2,843,491, mercaptothiadiazoles such as those described in U.S. Pat. No. 3,364,028, and so forth: polyhydroxybenzenes including catechols such as those described in U.S. Pat. No. 3,236,652 and Japanese Patent Examined Publication No. 43-10256 (1968), resorcines such as those described in Japanese Patent Examined Publication No. 56-44413 (1981). gallates such as those described in Japanese Patent Examined publication No. 43-4133 (1968), and so forth: azoles including tetrazoles such as those described in West German Patent No. 1,189,380, triazoles such as those described in U.S. Pat. No. 3,157,509, benztriazoles such as those described in U.S. Pat. No. 2,704,721, urazols such as those described in U.S. Pat. No. 3,287,135, pyrazoles such as those described in U.S. Pat. No. 3,106,467, indazoles such as those described in U.S. Pat. No. 2,271,229, polymer benzotriazoles such as those described in Japanese Patent O.P.I. Publication No. 59-90844 (1984), and so forth; heterocyclic compounds including pyrimidines such as those described in U.S. Pat. No. 3,161,515, 3-pyrazolidones such as those described in U.S. Pat. No. 2,751,297, polymerized pyrolidones, i.e.. polyvinyl pyrolidones, such as those described in U.S. Pat. No. 3,021,213, and so forth: various types of inhibitor-precursors including those described in Japanese Patent O.P.I. Publication Nos. 54-130929 (1979), 59-137945 (1984) and 59-140445 (1984), British Patent Nos. 1,356,142, U.S. Pat. Nos. 3,575,699 and 3,649,267, and so forth; sulfonic acid and the derivatives thereof including those described in U.S. Pat. No. 3,047,393; inorganic salts including those described in U.S. Pat. Nos. 2,566,263, 2,839,405, 2.488,709 and 2,728,663; and so forth.

If required, various kinds of photographic additives including, for example, gelatin plasticizing agents. hardening agents, surface active agents, image-stabilizers. UV absorbing agents, antistaining agents, pH-adjusting agents, antioxidizing agents, antistatic agents, thickening agents, graininess improving agents, dye-stuffs, mordants, whitening agents, development-rate adjusting agent, matting agents and so forth may be added into any of the hydrophilic colloidal layers of a light-sensitive material of the invention, provided that the effects and advantages of the invention shall not be affected. Among the above-given various additives, the following additives are particularly preferable to be applied to the invention.

The preferable plasticizing agents include, for example, those described in Japanese Patent O.P.I. Publication No. 48-63715 (1973), British Patent No. 1,239,337, U.S. Pat. No. 2,327,808, 2,759,821, 2,772,166, 2,835,582, 2,860,980, 2,865,792, 2,904,434, 2,960,404, 3,003,878, 3,033,680, 3,173,790, 3,287,289, 3,361,565, 3,397,988, 3,412,159, 3,520,694, 3,520,758, 3,615,624, 3,635,853, 3,640,721, 3,656,956, 3,692,753 and 3,791,857, and so forth.

The preferable hardening agents include, for example, those of the aldehyde or aziridine type, such as described in P. B. Report No. 19921, U.S. Pat. Nos. 2,950,197, 2,964,404, 2,983,611 and 3,271,175, Japanese Patent Examined Publication No. 46-40898 (1971), and Japanese Patent O.P.I. Publication No. 50-91315 (1975), those of the isooxazole type, those of the epoxy type, such as described in U.S. Pat. No. 3,047,394, West German Patent No. 1,085,663, British Patent No. 1,033,518, and Japanese Patent Examined Publication No. 48-35495 (1973), those of the vinylsulfone type, such as described in P.B. Report No. 19,920, West German Patent Nos. 1,100,942, 2,337,412, 2,545,722, 2,635,518, 2,742,308 and 2,749,260, British Patent No. 1,251,091, Japanese Patent Examined Publication No. 49-13563 (1974) Japanese Patent O.P.I. Publication No. 50-62250 (1975), and U.S. Pat. Nos. 3,539,644 and 3,490,911, those of the acryloyl type, such as described in Japanese Patent Examined Publication No. 53-778 (1978) and U.S. Pat. No. 3,640,720, those of the carbodiimide type, such as described in U.S. Pat. Nos. 2,938,892, 4,043,818 and 4,061,499, Japanese Patent Examined Publication No. 46-38715 (1971), and Japanese Patent O.P.I. Application No. 49-15095 (1974), those of the triazine type, such as described in West German Patent Nos. 2,410,973 and 2,553,915, U.S. Pat. No. 3,325,287, and Japanese Patent O.P.I. Publication No. 52-12722 (1977), those of the high molecule type, such as described in British Patent No. 822,061, U.S. Pat. Nos. 3,623,878, 3,396,029 and 3,226,234, and Japanese Patent Examined Publication Nos. 47-18578 (1972), 47-18579 (1972) and 47-48896 (1972), and, besides, the hardening agents of the maleimide, acetylene, methanesulfonate or N-methylol type may also be used independently or in combination. The useful techniques for these combinations are described in, for example, West German Patent Nos. 2,447,587, 2,505,746 and 2,514,245, U.S. Pat. Nos. 4,047,957, 3,832,181 and 3,840,370, Japanese Patent O.P.I. Publication Nos. 48-43319 (1973), 50-63062 (1975) and 52-127329 (1977), and Japanese Patent Examined Publication No. 48-32364 (1973). The preferable hardening agents those capable of reacting with the carboxy group of gelatin.

The preferable UV absorbing agents include, for example, benzophenone compounds such as those described in Japanese Patent O.P.I. Publication No. 46-2784 (1971) and U.S. Pat. Nos. 3,215,530 and 3,698,907, butadiene compounds such as those described in U.S. Pat. No. 4,045,229, and cinnamic acid ester compounds such as those described in U.S. Pat. Nos. 3,705,805 and 3,707,375 and Japanese Patent O.P.I. Publication No. 52-49029. Further, those described in U.S. Pat. No. 3,499,762 and Japanese Patent O.P.I. Publication No. 54-48535 (1976) may also be used. Still further, It is allowed to use UV-absorbable couplers such as α-naphtholtype cyan-dye-forming couplers or UV-absorbable polymers such as those described in Japanese Patent O.P.I. Publication Nos. 58-111942 (1983), 58-178351 (1983), 58-181041 (1983), 59-19945 (1984) and 59-23344 (1984), and so forth. The above-mentioned UV absorbing agents may be mordanted on a specific layer.

The whitening agents include, preferably, fluorescent whitening agents such as those of the stilbene, triazine, pyrazoline, coumarin or acetylene type. These compounds may be of either water-soluble or insoluble, provided that the insoluble compounds are to be in the form of a dispersion.

The anionic surface active agents include, preferably, those each containing such an acidic group as a group of carboxy, sulfo, phospho, sulfate, phosphate or the like, namely, an alkylcarboxylate, an alkylsulfonate, an alkylbenzeneb sulfonate, an alkylnaphthalene sulfonate, an alkyl sulfate, an alkyl phosphate, an N-acyl-alkyl taurine, a sulfo succinate, a sulfoalkylpolyoxyethylene alkylphenyl ether, a polyoxyethylenealkyl phosphate and so forth.

The amphoteric surface active agents include, preferably, an amino acid, an aminoalkylsulfonic acid, an aminoalkyl sulfate or aminoalkyl phosphate, an alkylbetaine, an amine oxide, and so forth.

The cationic surface active agents include, preferably, an alkylamine salt, an aliphatic or aromatic quaternary ammonium salt, a heterocyclic quaternary ammonium salt such as pyridinium, imidazolium or the like, a phosphonium or sulfonium salt of the aliphatic or heterocyclic type, and so forth.

The nonionic surface active agents include, preferably, those of the steroid type such as saponine, alkylene oxide derivatives such as polyethylene glycol, a polyethylene glycol/polypropylene glycol condensate, a polyethylene glycol alkyl ether or a polyethylene glycol alkylaryl ether, a polethylene glycol ester, polyethylene glycol sorbitane ester, a polyalkylene glycol alkyl amine or a polyalkylene glycol alkyl amide, and polyethylene oxide addition products of silicone, glycidol derivatives such as an alkenyl succinic acid polyglyceride and alkylphenol polyglyceride, aliphatic esters of polyhydric alcohol, alkyl esters of sugar, and so forth.

The matting agents include, preferably, organic matting agents such as those described in British Patent No. 1,055,713, U.S. Pat. Nos. 1,939,213, 2,221,873, 2,268,662, 2,332,037, 2,376,005, 2,391,181, 2,701,245, 2,992,101, 3,079,257, 3,262,782, 3,516,832, 3,539,344, 3,591,379, 3,754,924 and 3,767,448, and so forth, inorganic matting agent such as those described in West German Patent No. 2,592,321, British Patent Nos. 760,775 and 1,260,772, U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504, and so forth.

The antistatic agents include, preferably, the compounds such as those described in British Patent No. 1,466,600, Research Disclosure Nos. 15840, 16258 and 16630, U.S. Pat. Nos. 2,327,828, 2,861,056, 3,206,312, 3,245,833, 3,428,451, 3,775,126, 3,963,498, 4,025,342, 4,025,463, 4,025,691 and 4,025,704, and so forth.

It is preferable that the light-sensitive materials relating to the invention are to contain polymer latexes. The preferable polymer latexes which are to be contained in the light-sensitive materials include, for example, those described in U.S. Pat. Nos. 2,772,166, 3,325,286, 3,411,911, 3,311,912 and 3,525,620, Research Disclosure No. 19551, July, 1980, and so forth, such as vinyl polymer hydrates of acrylates, methacrylates, styrenes or the like.

The preferable polymer latexes include, for example, methalkyl acrylate homopolymers such as methyl methacrylate, ethyl methacrylate and so forth, styrene homopolymers, copolymers of methacrylate or styrene and acrylic acid, N-methylol acrylamide, glycidol methacrylate or the like, alkyl acrylate homopolymers such as methyl acrylate, ethyl acrylate, butyl acrylate and so forth, copolymers of alkyl acrylate and acrylic acid or N-methylol acrylamide, and so forth, provided that the copolymer component of acrylic acid or the like is preferably not more than 30 wt %, butadiene homopolymers, copolymers of butadiene and styrene or one or more butoxymethyl acrylamidoacrylic acids, vinylidene-methyl acrylate-acrylic acid ternary copolymer, and so forth.

In the polymer latexes applicable to the invention, the average grain size thereof is within the range of preferably from 0.005 to 1 μ and more preferably from 0.01 to 0.5 μ.

The polymer latexes applicable to the invention may be contained in either only one side of a support or the both sides thereof and, more preferably, in the both sides thereof. When containing in the both sides of the support, the polymer latexes contained in each side of the support may be either of the same kind or the different kinds and/or either in the same amount or in the different amounts.

The polymer latexes may be added to any layers. In the case that they are added to the side of the support provided with a silver halide light-sensitive layer, the polymer latexes may be added in either the silver halide light-sensitive layer or in the uppermost non-light-sensitive colloidal layer that is so-called a protective layer. It is the matter of course that they may be added to an interlayer, provided that there are other layers such as the interlayer interposed between the silver halide light-sensitive layer and the uppermost layer. In addition, when a support side comprises a plurality of layers, the polymer latexes may be added either in a single layer of the layers or in any combination of a plurality of the layers not limitative to two layers.

Typical examples of the latexes, L-1 through L-23, which are preferably applicable to the embodiments of the invention will be given below.

L-1
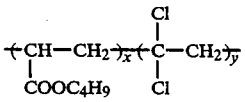
x/y = 50/50
Wherein, x and y, and z and w of which will be described later, each represent a mol-ratio, and so forth on.
L-2
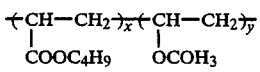
x/y = 50/50
L-3
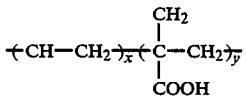
x/y = 95.6/4.4
L-4
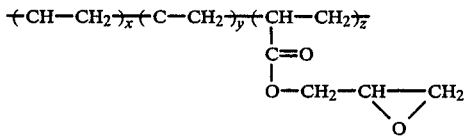
x/y/z = 40/20/40
L-5
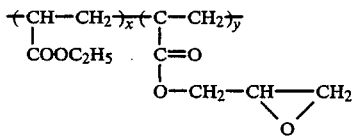
x/y/ = 50/50
L-6
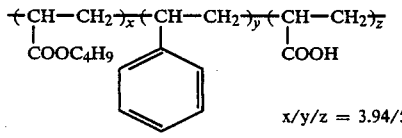
x/y/z = 3.94/59/1.6
L-7
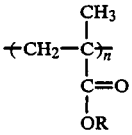
R: $-CH_3$, $-C_2H_5$, $-C_4H_9$
L-8
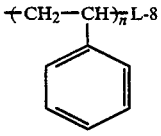
L-9
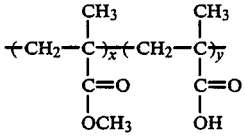
x/y = 93/7

-continued
L-10
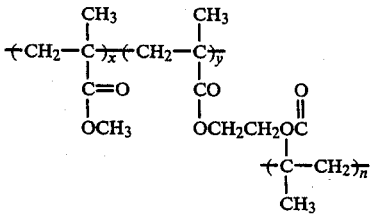
x/y = 93/7
L-11
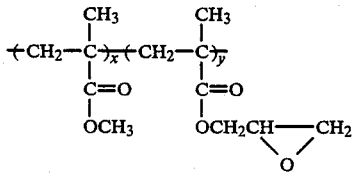
x/y = 93/7
L-12
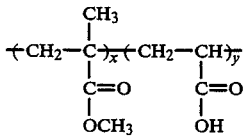
x/y = 93/7
L-13
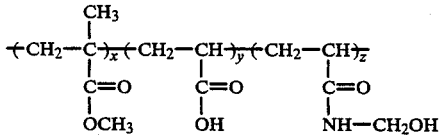
x/y/z = 93/3/4
L-14
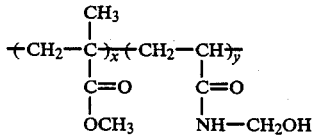
x/y = 93/7
L-15
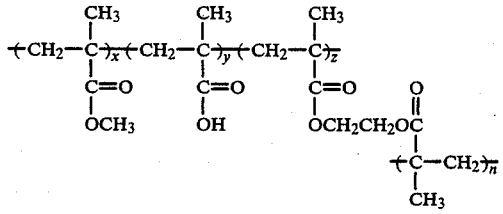
x/y/z = 93/3/4
L-16
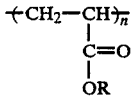
R: $-CH_3$, $-C_2H_5$, $-C_4H_9$
L-17
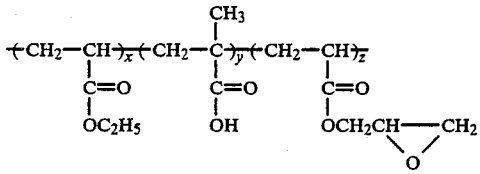
x/y/z = 93/3/4

-continued

L-18

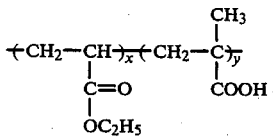

x/y = 93/7

L-19

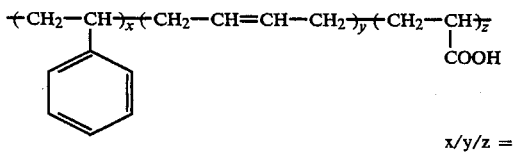

x/y/z = 59/39/12

L-20

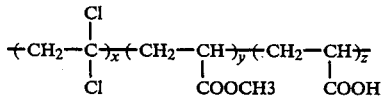

x/y/z = 85/13/2

L-21

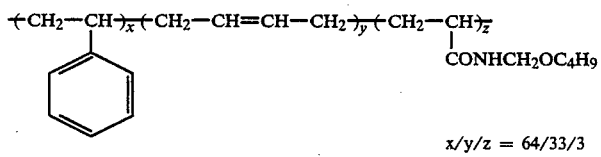

x/y/z = 64/33/3

L-22

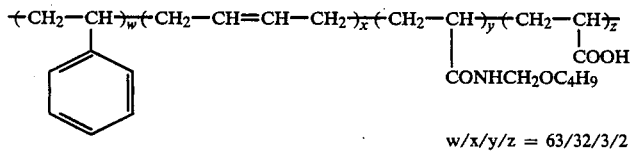

w/x/y/z = 63/32/3/2

L-23

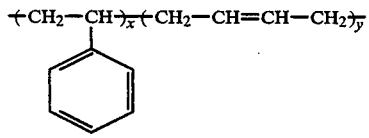

x/y = 67/33

Gelatin is used to serve as the binders applicable to the light-sensitive materials of the invention. The gelatin include, for example, gelatin derivatives and so forth. It is also allowed to use, in combination with the above-mentioned gelatin, cellulose derivatives, graft polymers of gelatin and other high molecular substances and, besides, protein, sugar derivatives, and hydrophilic colloids comprising homo- or co-polymers of synthesized hydrophilic high-molecular substances or the like.

To serve as the gelatin, it is also allowed to use acid-treated gelatin and enzyme-treated gelatin such as those given in 'Bulletin of Society of Science and Photography of Japan', No. 16, p. 30, 1966, as well as lime-treated gelatin. The hydrolyzed matters of gelatin and the enzyme-decomposed matters may further be used. The gelatin derivatives applicable thereto include, for example, those prepared by reacting gelatin with such a compound as an acid halide, an acid anhydride, an isocyanate, bromoacetic acid, an alkanesultone, a vinylsulfonamide, a maleinimide compound, a polyalkylene oxide, an epoxy compound or the like. The typical examples thereof include those described in U.S. Pat. Nos. 2,614,928, 3,132,945, 3,186,846 and 3,312,553, British Patent Nos. 861,414, 1,033,189 and 1,005,784, Japanese Patent Examined Publication No. 42-26845 (1967), and so forth.

The proteins include, for example, albumin and casein.

The cellulose derivatives include, for example, hydroxyethyl cellulose, carboxymethyl cellulose and a cellulose sulfate.

The sugar derivatives include, for example, sodium alginate, and it is also allowed to use a starch derivative together with gelatin in combination.

To serve as the graft polymers of gelatin and other high molecular substances, it is allowed to use those prepared by grafting, in gelatin, a homo- or co-polymer of vinyl type monomers such as acrylic acid, methacrylic acid, an acrylate, a methacrylate, the derivatives of acrylamide, methacrylamide or the like, acrylonitrile, styrene and so forth. It is Particularly preferable to use graft polymers of gelatin an polymers such as those of acrylic acid, acrylamide, methacrylamide, hydroxyalkyl methacrylate or the like, each having a compatibility in some extent with gelatin. The examples thereof are described in U.S. Pat. Nos. 2,763,625, 2,831,767 and 2,956,884, and so forth.

The amount of gelatin to be coated is preferably from 1.8 g/m$^2$ to 5.5 g/m$^2$ per one side of a support and more preferably from 2.0 g/m$^2$ to 4.8 g/m$^2$ when the same side of a light-sensitive material does not contain polymer latexes in any other layers than in an under-coat layer, and preferably from 1.5 g/m$^2$ to 6.0 g/m$^2$ and more preferably from 1.8 g/m$^2$ to 5.5 g/m$^2$ when the side thereof contains polymer latexes.

The supports applicable to the light-sensitive materials of the invention include, for example, flexible reflective supports such as a sheet of paper or synthetic paper laminated with α-olefin polymer or the like, such as a polyethylene/butene copolymer, a sheet of film comprising semi-synthetic or synthetic high molecular substances such as cellulose acetate, cellulose nitrate, polystyrene, polyvinyl chloride, polyethyleneterephthalate, polycarbonate, polyamide and so forth, flexible film supports each provided with a reflective layer, metal plate supports, and so forth.

Among these supports, that of polyethyleneterephthalate is particularly preferable.

The under-coat layers applicable to the invention include, for example, under-coat layers coated with an organic solvent containing polyhydroxybenzenes, such as those described in Japanese Patent O.P.I. Publication No. 49-3972 (1974), under-coated layers coated with water latexes, such as those described in Japanese Patent O.P.I. Publication Nos. 49-11118 (1974), 52-104913 (1977), 59-19941 (1984), 59-19940 (1984), 59-18945 (1984), 51-112326 (1976), 51-117617 (1976), 51-58469 (1976), 51-114120 (1976), 51-121323 (1976), 51-123139 (1976), 51-114121 (1976), 52-139320 (1977), 52-65422 (1977), 52-109923 (1977), 52-119919 (1977), 55-65949 (1980), 57-128332 (1982) and 59-19941 (1984), and so forth.

The above-mentioned under-coat layers may usually be surface-treated either chemically or phisically. These treatments include, for example, surface-activation treatments such as treatments made with chemicals, mechanical treatments, corona-discharge treatments, flame treatments, UV-rays treatments, high-frequency treatments, glow-discharge treatments, active-plasma treatments, laser treatments, mixed acid treatments, ozone-oxidation treatments and so forth, The under-coat layers are distinct from the coated layers relating to the invention and shall not therefore be limited to the time or conditions for coating.

Japanese Patent Examined Publication Nos. 26-7777 (1951), 39-22069 (1964) and 54-38129 (1979), Japanese Patent O.P.I. Publication Nos. 48-85130 (1973), 49-99620 (1974), 49-114420 (1974), 49-129537 (1974), 50-28827 (1975), 52-108115 (1977), 57-185038 (1982) and 59-24845 (2984), U.S. Pat. Nos. 1,878,961, 1,884,035, 1,912,797, 2,098,891, 2,150,695, 2,274,782, 5,298,731, 2,409,612, 2,461,484, 2,527,583, 2,533,472, 2,865,752, 2,956,879, 3,094,418, 3,125,448, 3,148,187, 3,177,078, 3,247,127, 3,260,601, 3,282,699, 3,409,433, 3,540,887, 3,575,704, 3,653,905, 3,718,472, 3,865,817, 4,070,352 and 4,071,312, P.B. Report No. 4175, Photographic Abstract, 1, 28, '21, and so forth.

Particularly in roomlight contact type light-sensitive materials, it is preferred to use the above-given dyes and, more preferable to use so as to make a sensitivity to 400 nm light 30 or more times faster than a sensitivity to 360 nm light.

When embodying the invention, it is further allowed to use organic desensitizers such as those described in Japanese Patent O.P.I. publication No. 61-26041 (1986) and so forth, in which the sum of both anodic and cathodic potentials of polarograph is positive.

to be continued

The desensitizing dyes applicable for achieving the objects of the invention preferably include compounds each of which the total of the anodic and cathodic potentials of a polarograph is positive. This kind of compounds are described in many patents and literatures and any of them may be used. Particularly, the compounds represented by the following Formulas I through VI given in the above-mentioned Japanese Patent Application are preferably be used as the desensitizing dyes.

The compounds may be synthesized with reference to the descriptions of U.S. Pat. Nos. 3,567,456, 3,615,639, 3,579,345, 3,615,608, 3,598,596, 3,598,955, 3,592,653 and 3,582,343, Japanese Patent Examined publication Nos. 40-26751 (1965), 40-27332 (1965), 43-13167 (1968), 45-8833 (1970) and 47-8746 (1972), and so forth.

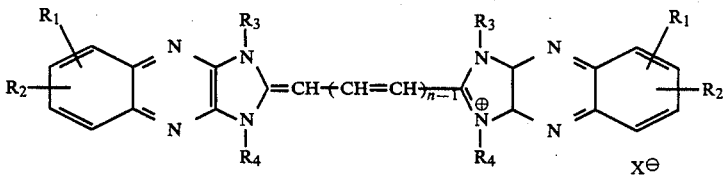

Formula I

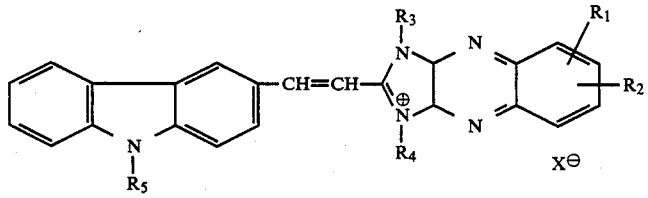

Formula II

In the invention, it is allowed to use a filter dye or, dyes with the purpose of preventing halation and various other purposes. The dyes applicable to the invention include, for example, a triallyl dye, an oxanol dye, a hemioxanol dye, a merocyanine dye, a cyanine dye, a styryl dye and an azo dye. Among them, the oxanol dyes, hemioxanol dyes and merocyanine dyes are particularly useful. The typical examples of the applicable dyes include those described in West German Patent No. 616,007, British Patent Nos. 584,609 and 1,177,429, In the above-given Formulas I and II, $R_1$ and $R_2$ each represent a hydrogen or halogen atom, a cyano group or a nitro group, and $R_1$ and $R_2$ together may complete an aromatic ring;

$R_3$ and $R_4$ each represent a group of alkyl, lower alkenyl, phenyl or lower hydroxyalkyl, and they are aryl groups, provided that $R_1$ and $R_2$ each are others than hydrogen atom;

n is an positive integer of 1 through 4;

$R_5$ represents a group of lower alkyl or sulfonated lower alkyl; and $X^{74}$ represents an acid anion.

Formula III

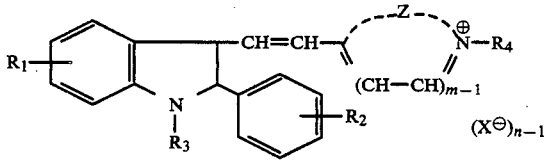

In the above-given Formula III, $R_1$ and $R_2$ each represent hydrogen atom or a nitro group; $R_3$ and $R_4$ each represent a group of lower alkyl, allyl or phenyl; Z represents a group consisting of atoms necessary to complete a nucleus of nitrobenzothiazole, nitrobenzoxazole, nitrobenzoselenazole, imidazo[4.5-b]quinoxaline, 3.3-dimethyl-3H-pyrrolo-[2.3-b]pyridine, 3 3-dialkyl-3H-nitroindole, thiazolo[-4.6-b]quinoline, nitroquinoline, nitrothiazole, nitronaphthothiazole, nitroxazole, nitronaphthoxazole, nitroselenazole, nitronaphthoselenazole or nitropyridine: $X^{\theta}$ represents an anion; and m and n each are an integer of 1 or 2, provided that n is 1 when a compound forms an intramolecular salt.

Formula IV

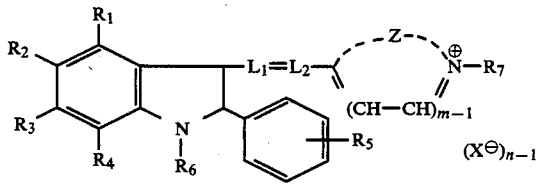

In the above-given Formula IV, $R_1$, $R_2$, $R_3$ and $R_4$ each represent a hydrogen or halogen atom, or a group of alkyl, alkoxy, aryloxy or nitro, $R_5$ represents a hydrogen atom or a group of alkyl or nitro; Z represents a group consisting of atoms necessary to complete a nucleus of thiazole, benzothiazole, naphthothiazole, oxazole, benzoxazole, naphthoxazole, selenazole, benzoselenazole, naphthoselenazole, thiazoline, pyridine, quinoline, isoquinoline, 3,3-dialkyl-3H-indole, imidazole, benzoimidazole or naphthimidazole, which is not substututed or substituted with a lower alkyl group, a phenyl group, a thienyl group, a halogen atom, an alkoxy group, a hydroxy group, a cyano group, an alkylsulfonyl group, an alkoxycarbonyl group, a phenylsulfonyl group, or a trifluoromethyl group; $L_1$ and $L_2$ each represent a methine chain which is non-substituted or substituted with a lower alkyl group or an aryl group: $R_6$ and $R_7$ each represent a group of alkyl, alkenyl, aryl, sulfalkyl or aralkyl which is non-substituted or has a substituent: $X^{\theta}$ represents an anion: and, m and n are integer of 1 or 2, provided that n is 1 when a compound forms an intramolecular salt.

Formula V

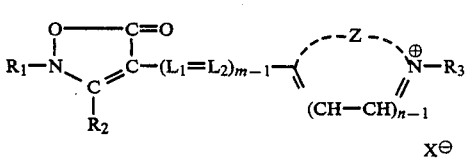

In the above-given Formula V, $R_1$ and $R_3$ each represent an alkyl group; $R_2$ represents an aryl group; $L_1$ and $L_2$ each represent a methine chain non-substituted or substituted with a lower alkyl group or a aryl group; Z represents a group consisting of atoms necessary to complete a nucleus of thiazole, benzothiazole, naphthothiazole, oxazole, benzoxazole. naphthoxazole, selenazole, benzoselenazole. napthoselenazole, thiazoline, pyridine, quinoline, 3.3-dialkylindolenine, imidazole or imidazo[4.5-b]quinoxaline: X represents an anion; m is a positive integer of 1 to 3; and n is a positive integer of 1 or 2.

Next, the typical compounds represented by the above-given Formulas I through V will be exemplified below. It is, however, the matter of course that the invention shall not be limited to the following exemplified compounds. In the following exemplified compounds, the term, Pts. represents a paratoluenesulfonic acid anion.

Exemplified Compounds (1)

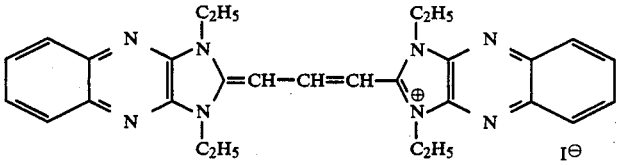

(2)

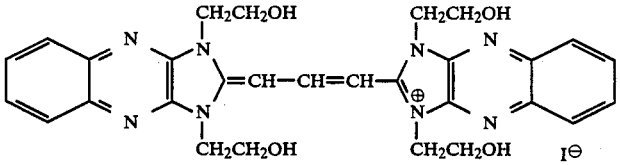

(3)

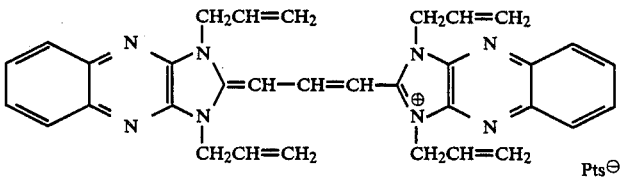

-continued
Exemplified Compounds
(4)
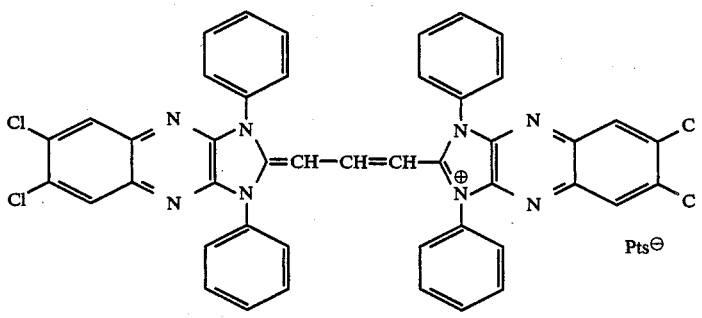
(5)
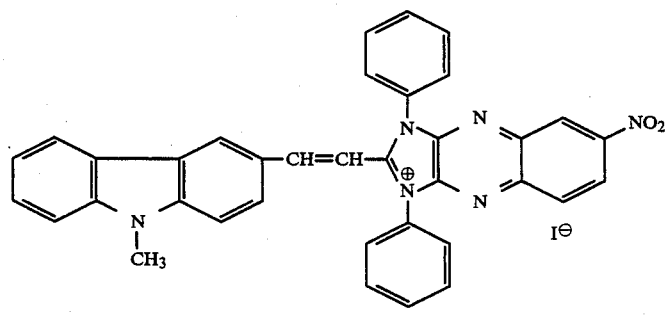
(6)
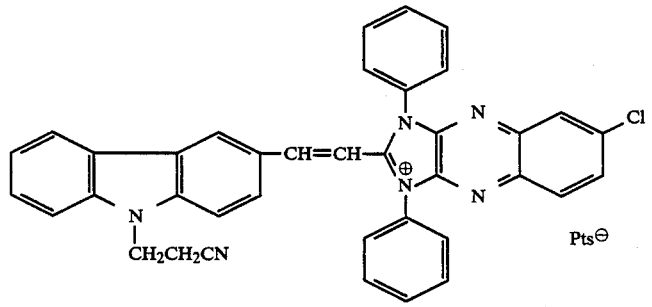
(7)
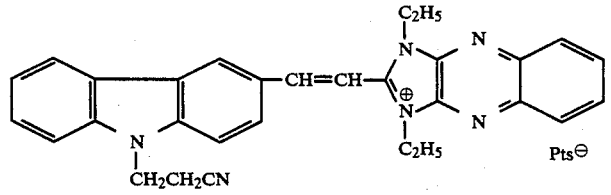
(8)
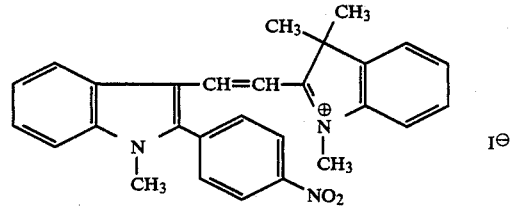
(9)
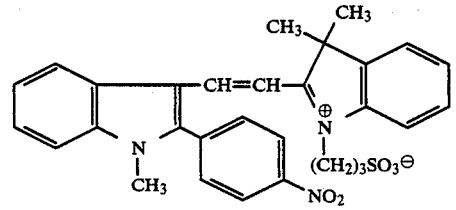

-continued
Exemplified Compounds
(10)
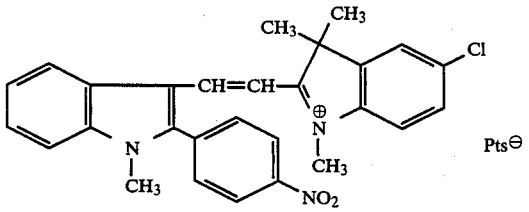
(11)
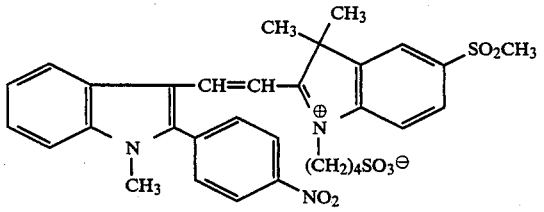
(12)
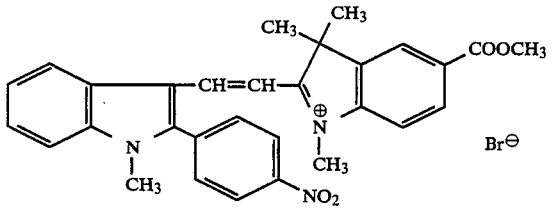
(13)
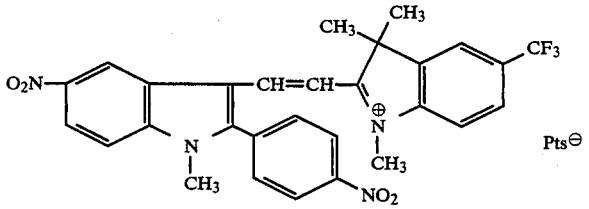
(14)
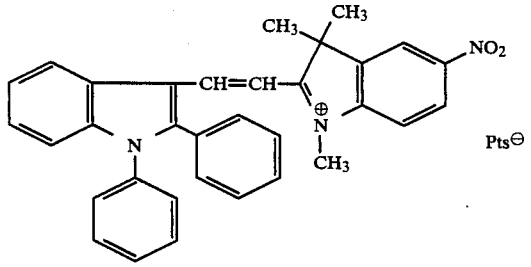
(15)
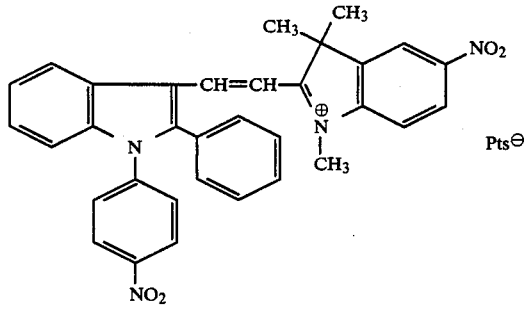

-continued
Exemplified Compounds
(16)
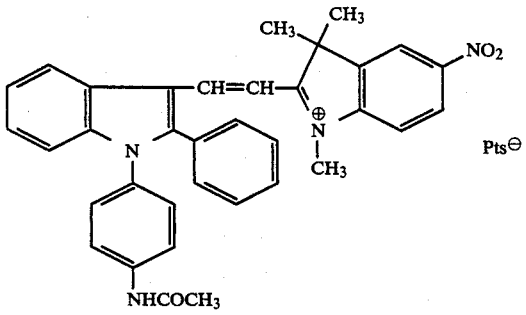
(17)
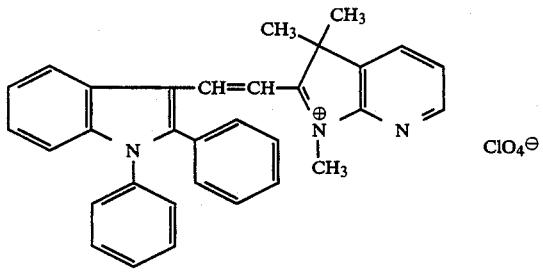
(18)
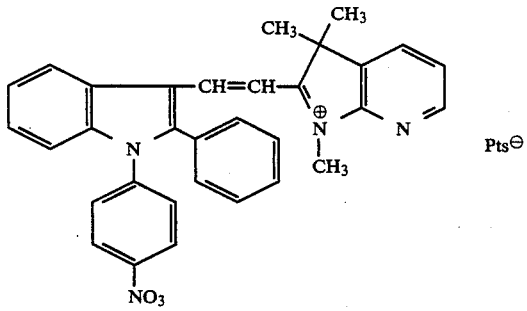
(19)
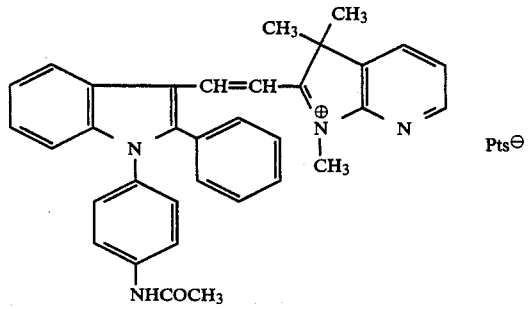
(20)
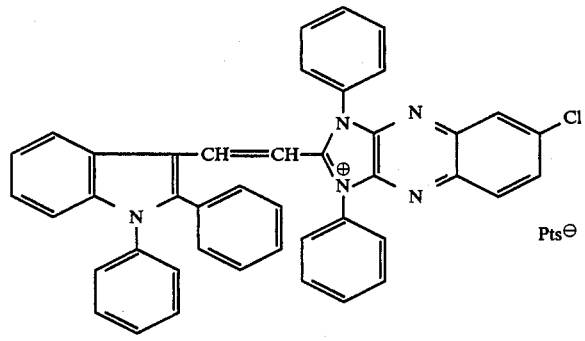

-continued
Exemplified Compounds
(21)
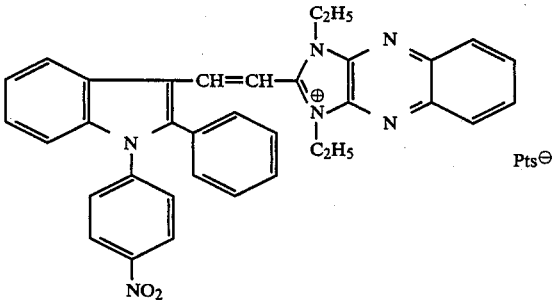
(22)
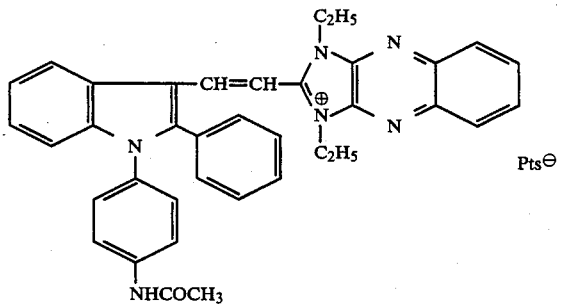
(23)
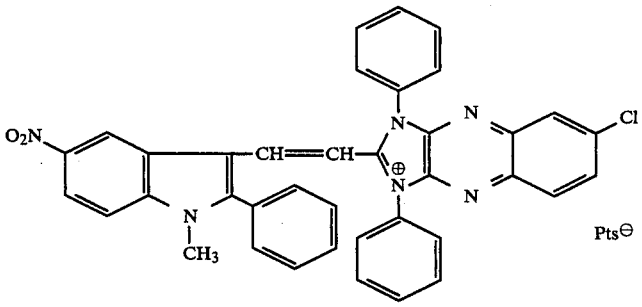
(24)
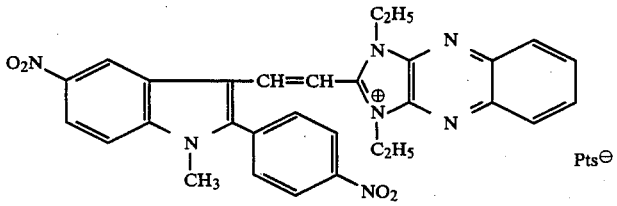
(25)
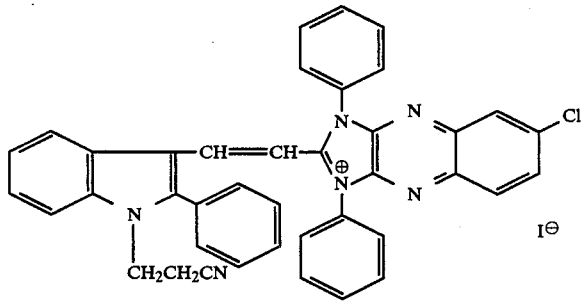
(26)
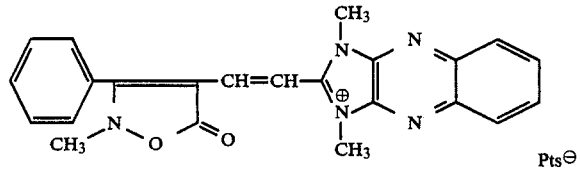

-continued

Exemplified Compounds (27)

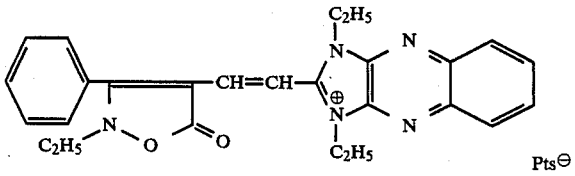

The desensitizing dyes relating to the invention are selectively used in an amount of, preferably, from 1 mg to 1,000 mg per mol of silver halide used and, more preferably, from 5 mg to 300 mg. They may be added at any points of time, such as a time when a silver halide is produced or a physical or chemical ripening is being carried out, after the ripening is completed, or a time when a coating solution is being prepared. It is desirable that the desensitizing dyes of the invention have a sensitivity of not higher than 450 nm so as to prevent the sensitivity from being lowered and a maximum wavelength of spectral sensitivity of not less than 500 nm.

Any light-sensitive materials of the invention can be exposed to light by making use of electromagnetic waves of a spectral wave region to which the emulsion layers of the light-sensitive material are sensitive. As for the light sources applicable for this exposure, any of the well-known light sources may be used. They include, for example, natural light, i.e., daylight, a tungsten lamp, a fluorescent lamp, an iodine-quartz lamp, a mercury lamp, a microwave-emitting UV lamp, a Xenon-arc lamp, a carbon-arc lamp, a Xenon-flash lamp, flying spot by a cathode-ray tube, a variety of laser beams, a light-emmitting diode, light emitted from a phosphor excited by electron-, X-, $\gamma$- or $\alpha$-rays, and so forth. Particularly, with a light-sensitive material of the invention have a maximum sensitivity to a light of not more than 450 nm, even when the light-sensitive layer thereof is exposed imagewise to light of not substantially lower than 370 nm, a preferable result may be obtained. In a roomlight contact type light-sensitive material, it is particularly preferable that the sensitivity to light of 400 nm should be not less than 30 times higher than the sensitivity to light of 360 nm.

Next, the methods for 'exposing imagewise a light-sensitive layer to light of substantially not lower than 360 nm' include, for example, a method in which a UV absorbing agent is contained in a light-sensitive material, another method in which an optical filter is used for absorbing UV rays, a further method in which a light source not having substantially any light-emmission energy of not higher than 370 nm is used, and so forth.

Now, the first-mentioned method will be described.

As for the UV absorbing agents, a substance capable of reducing the inheric sensitivity of a silver halide emulsion to be not more than one half, that is a UV absorbing agent having a peak of from 300 to 400nm and, more preferaly, from 300 to 380 nm.

The UV absorbing agents applicable thereto include, for example, a benzotriazole compound, a 4-thiazolidone compound, a benzophenone compound, a cinnamic acid ester compound, a butadiene and a benzoxazole compound each substituted with an aryl group, and a UV absorbing agent polymer.

The typical examples of the UV absorbing agents are described in U.S. Pat. Nos. 3,533,794, 3,314,894 and 3,352,681, Japanese Patent O.P.I. Publication No. 46-2784 (1971), U.S. Pat. Nos. 3,705,805, 3,707,375, 4,045,229, 3,700,455 and 3,499,762, West German DAS Patent Nos. 1,547,563, and so forth.

In the invention, it is allowed to use the typical compounds given in Japanese Patent O.P.I. Publication No. 62-210458 (1987).

In the invention, the UV absorbing agent is so added as to reduce the inheric sensitivity of a silver halide emulsion to be not more than one half. They are to be added in such an amount that the absorptivity may become not less than 0.3 at 360 nm and, more preferably, not less than 0.4 at 360 nm.

An amount added depends on the molar absorptivities of UV absorbing agents. However, they are usually added within the range of from $10^{-2}$ g/m$^2$ to 1 g/m$^2$ and, more preferably, from 50 mg/m$^2$ to 500 mg/m$^2$.

The UV absorbing agents of the invention are contained in an emulsion layer, a surface protective layer, an interlayer and so forth.

It is allowed to add the above-mentioned UV absorbing agents in the coating solution for a non-light-sensitive hydrophilic colloidal layers of the invention, after they are dissolved in an appropriate solvent such as water, alcohol including methanol, ethanol, propanol or the like, acetone, methyl cellosolve and so forth or the mixtures thereof.

It is also allowed to use these UV absorbing agents in combination.

In the invention, the above-mentioned safelight dyes and the UV absorbing agents may be present together in one and the same layer or in the different layers separately.

Now, the second method will be described. the UV absorbent optical filters, i.e., filters for light-sources, applicable to this method include, preferably, a filter almost incapable of trasmitting rays of light having 370 nm or lower, such as Acrilite AR-1001 manufactured MITSUBISH Rayon Co., thickness 4 mm. To be more concrete, the transmissivity of these filters should preferably be not higher than 20% and, more preferably, be not higher than 10%.

Next, the third methd will be described. The light sources themselves substantially not having a light emission energy in the areas of not higher than 370 nm include, for example, those sold under the trade names: 'EYE DOLPHIN' manufactured by EYE GRAPHICS Co., Ltd.; a light source for Graphic art printer P-603 manufactured by Dainippon Screen Mfg. Co., Ltd.; a metal halide lamp Type SPG-2000 (2KW) manufactured by Japan Storage Battery Co., Ltd.; and so forth.

As for the light sources applicable to the third method, those having a light emission energy of not higher than 30% in the area from 300 nm to 370 nm among the aforespecified area of from 300 nm to 420 nm may preferably be used and those having the energy of not higher than 20% may more preferably be used.

It is further allowed that roomlight processable light-sensitive material emboding the invention can be exposed to a light source having a higher intensity than those of the conventional room light sources through a UV-absorbing optical filter for light sources. Those high-intensity light sources applicable thereto include, for example, an ultra-high pressure mercury vapour lamp, H-15-L31 (15KW), manufactured by EYE GRAPHICS Co., Ltd., and so forth.

When exposing a light-sensitive material to a light source by interposing a UV-absorbing optical filter for light sources between the light-sensitive material and the light source, the conventionally known light sources may be used for such a purpose that a layer containing a UV absorbing agent or the like is provided into a light-sensitive material so that the rays of light substantially not containing the rays of light of not more than 370 nm may reach a light-sensitive layer, or for the like purposes. Such light sources as mentioned above include, for example, the light source for the graphic art printer, P-607, that is, an ultra high pressure mercury vapour lamp URT-CHM-1000 manufactured by Dainippon Screen Mfg. Co., Ltd., the light source for P-627FM manufactured by the same company, and so forth.

For the light-sensitive material for contact printing of the invention, the exposure time may be selected according to the intensity of a light source used, the sensitivity including the spectral sensitivity of a light-sensitive material used and so forth. It is usually exposed for a period of from 60 seconds to 5 seconds. In some case, it is allowed to expose it for such a long time as 2 to 3 minutes.

The invention can be applied to a variety of light-sensitive materials such as those for graphic arts, X-rays, general negative images, general reversal images, general positive images, direct positive images and so forth. When the invention is applied to graphic art light-sensitive materials which require a very high dimensional stabilities between pre- and post-processing, the particularly remarkable effects can be enjoyed.

In the invention, a light-sensitive material can be processed in well-known methods including, for example, a variety of developing processes such as black-and-white, color, reversal or the like processes. The invention is particularly effective when processing a graphic art light-sensitive material capable of providing a high contrast.

When a tetrazolium or hydrazine compound is used as the hardening agent, a particularly preferable effect may be obtained by processing with a PQ or MQ type developer containing a sulfite in an amount of not less than 0.5 mol/liter at a pH of from 10.0 to 12.9. When a polyalkylene oxide compound is used as the hardening agent, a preferable effect can also be obtained by processing with a lith type developer as same as with the above-mentioned PQ and MQ type developers. The invention shall not be limited to the above-mentioned combination.

In the invention, the fixing solutions applicable to the treatments of a light-sensitive material are allowed to contain a variety of acids, salts, fixation accelerators, wetting agents, surface active agents, chelating agents, hardening agents as well as thiosulfates and sulfites. For example, the thiosulfates and sulfites include the potassium, sodium or ammonium salts thereof. The acids include sulfuric acid, hydrochloric acid, nitric acid, bolic acid, formic acid, acetic acid, propionic acid, oxalic acid, tartaric acid, citric acid, malic acid, phthalic acid and so forth. The salts include the salts of potassium, sodium, ammonium or the like of the acids. The wetting agents include alkanolamine, alkylene glycol and so forth. The chelating agents include aminoacetic acids such as nitrilotriacetic acid, EDTA and so forth.

In the invention, it is preferred that a fixing solution is to contain an aluminium compound so as to improve the layer hardness of a light-sensitive material. It is more preferred that the fixing solution is to contain such an aluminium compound in an amount of from 0.1 to 3 g/liter in terms of an aluminum content of the solution.

A sulfite concentration of a fixing solution is, preferably, from 0.03 to 0.4 mol per liter and, more preferably, from 0.04 to 0.3 mol per liter.

The preferable pH value of the fixing solution is from 3.9 to 6.5. When a fixing solution has a pH of this range, preferable photographic characteristics can be provided and the effects of the invention can also be displayed remarkably. The most preferable fixing solution has a pH value of from 4.2 to 5.3.

In the invention, the whole processing time of from 20 to 60 seconds includes the total period of time required for the whole step comprising a developing, fixing, washing, drying and every in-between cross-over step. Developing seconds and fixing seconds of time may be specified quite independently and it is of course that one of the two processing periods may be either longer than the other or the same with each other. The preferable ratio of developing seconds to fixing seconds is from 1:0.3 to 1:3. A developing temperature and fixing temperature may be specified quite independently and it is of course that one of the two processing temperatures may be either higher than the other or the same with each other. A particularly preferable fixing temperature difference from a developing temperature is within the range of from −15° C. to +15° C. Washing water is preferably at an ordinary temperature from the viewpoint of a processing system, however, the water temperature may be raised by making use of a thermostat of the like.

The temperatures of developer and fixing solution are preferably from 20° C. to 45° C., respectively, from the viewpoints of the preservability and odor prevention of the processing solutions.

EXAMPLES

Now, the following examples further illustrate preferred embodiments within the scope of the invention. It is, however, the matter of course that the invention shall not be limited thereto.

EXAMPLE-1

In this example, the invention was applied to a roomlight contact type light-sensitive material so that a negative type silver halide light-sensitive material was prepared in the following manner so as to serve as the above-mentioned light-sensitive material.

PREPARATION OF EMULSIONS

Silver chlorobromide emulsions each having a silver bromide content of 2 mol % were prepared in the following manner.

As shown in Table-1, 5 types of silver chlorobromide emulsions each having an average grain sizes of from 0.10 μm to 0.4 μm were prepared in the manner that an aqueous solution containing a potassium salt of pentabromorodium in an amount of 23.9 mg per 60 g of silver nitrate, sodium chloride and potassium bromide and an aqueous silver nitrate solution were mixed together at the same time with stirring at the mixing temperatures shown in Table-1 for 25 minutes, respectively.

The resulted emulsions were added with 200 mg of 6-methyl-4-hydroxy-1,3,3*a*,7-tetrazaindene as a stabilizer and were then washed and desalted.

Each of the resulted emulsions was added with 20 mg of 6-methyl-4-hydroxy-1,3,3*a*,7-tetrazaindene and was then sulfur-sensitized. After the sulfur-sensitization, 6-methyl-4-hydroxy-1,3,3*a*, 7-tetrazaindene was added to serve as a stabilizer and was then added with water to make 260 ml, so that each of emulsions was prepared.

PREPARATION OF LATEX L FOR AN ADDITIVE TO EMULSION

A latex solution L for adding a monodisperse type emulsion solution having an average grain size of about 0.25 μm was prepared in the following manner.

A solution containing 40 liters of water added with 0.25 kg of sodium dextransulfate, KMDS manufactured by Meito Sangyo Co. and 0.05 kg of ammonium persulfate was added, at the liquid temperature of 81° C. while stirring in a nitrogen atmosphere and taking one hour, with a solution mixedly containing 4.51 kg of n-butyl acrylate, 5.49 kg of styrene and 0.1 kg of acrylic acid. After then, the resulted solution was added with 0.005 kg of ammonium persulfate and was further stirred for one and half hours and cooled. The pH of the resulted latex solution was adjusted to be pH 6 by making use of aqueous ammonia. The resulted latex solution was filtrated by making use of a GF/D filter manufactured by Whotman Co. and was added with water to make 50.5 kg, so that the latex solution L containing monodispersed particle having average size of 0.25 μm was prepared.

Silver halide emulsion coating solutions were prepared by adding the above-mentioned emulsions with the following additives, respectively.

PREPARATION OF EMULSION COATING SOLUTIONS

Emulsion coating solutions E-1 through E-4 were prepared in the following manner.

After each of the aforementioned emulsion solutions was wadded with 9 mg of Compound A as a pasteurizer, the pH of the resulted solution was adjusted to be 6.5 with a 0.5 normal sodium hydroxide solution and was then added with 360 mg of Compound I-2 and, further, with a 20% aqueous saponin solution in an amount of 5 ml per mol of silver halide used, 180 mg of sodium dodecylbenzenesulfinate, 80 mg of 5-methylbenzteriazole, 43 ml of the above-mentioned latex solution L for adding emulsion solution, 60 mg of the following Compound M and 280 mg of an aqueous polymer of a styrene-maleic acid copolymer in order. The resulted matter was added with water to make 475 ml.

Next, an emulsion-protective layer coating solution was prepared in the following manner.

Compound Z

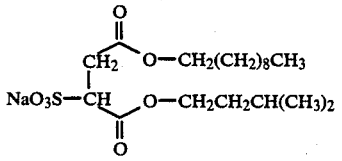

-continued

Compound M

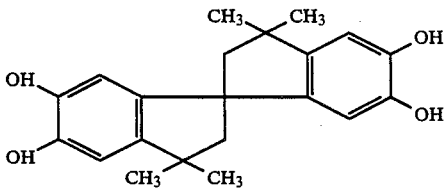

Compound N

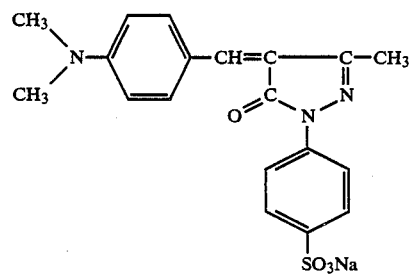

Compound 1-2

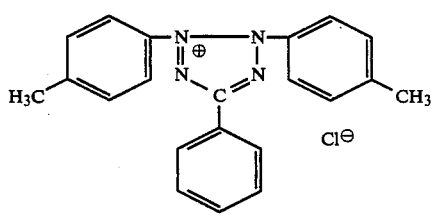

Compound A

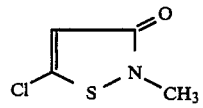

Compound B

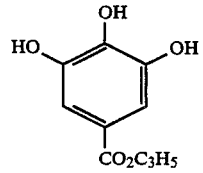

Next, a backing layer coating solution applied to coat a backing under-coat layer was prepared in the following manner.

PREPARATION OF BACKING LAYER COATING SOLUTION B-1

The solution B-1 was prepared in the following manner.

Gelatin of 36 kg were swollen in water and heated to be dissolved. Then, the resulted solution was added with the following Compounds. C-1 of 1.6 kg, C-2 of 310 g and C-3 of 1.9 kg each serving as the dyes and the aforegiven Compound N of 2.9 kg, which were formed into an aqueous solution in advance. Next, 11 liters of a 20% aqueous saponin solution and 5 kg of Latex C-4 were added and, further, 63 kg of the following Compound C-5 serving as a methanol solution and 270 g of the following Compound C-6 were added. The resulted solution were added with 800 g of a water-soluble polymer of styrene-maleic acid copolymer serving as a thickening agent. Then, the viscosity of the solution was adjusted and the pH thereof was also adjusted to be 5.4 with an aqueous citric acid solution. Finally, 144 g of glyoxal was added and water was then added to make 960 liters of the backing layer coating solution B-1.

Compound C-1

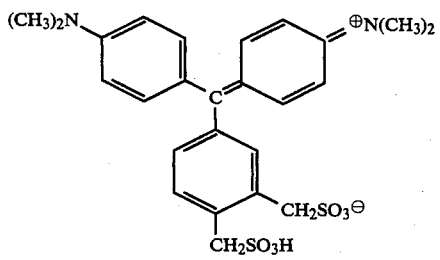

Compound C-2

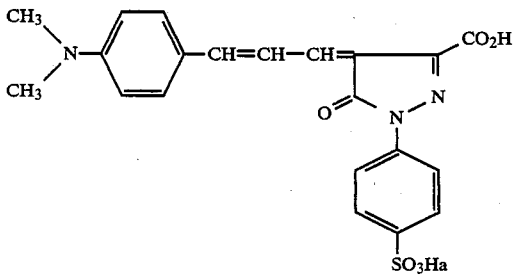

Compound C-3

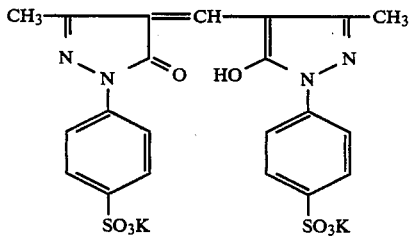

Compound C-4

Copolymer latex of

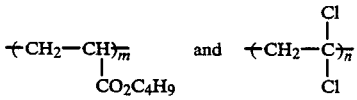

wherein m:n = 1:1

Compound C-5

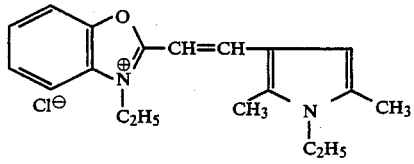

Compound C-6

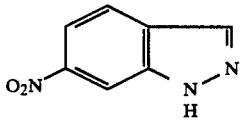

Next, Protective layer coating solution P-2 for a protective layer of a backing layer was prepared in the following manner.

PROTECTIVE LAYER COATING SOLUTION P-2

The coating solution P-2 was prepared in the following manner.

Gelatin of 50 kg were swollen in water and dissolved together with heating. Then, 340 g of sodium salt of 2-sulfonate-succinic acid bis(2-ethylhexyl)ester were added and 1.7 kg of polymethyl methacrylate having an average particle size of about 0.4 μm as a matting agent and 3.4 kg of sodium chloride were added. Further, 1.1 kg of glyoxal and 540 g of mucochloric acid were added. Water was so added as to make 1000 liters of the protective layer coating solution P-2.

PREPARATION OF SAMPLES FOR EVALUATION USE

Each of the foregoing coating solutions was coated, in combination shown in Table-1, on one side after another of both sides of a 100 μm-thick polyethylene terephthalate film support provided thereto with such an under-coat layer as described in Example-1 of Japanese Patent O.P.I. publication No. 59-09941 (1984), so that each of the samples for evaluation use was prepared. In this preparation process, on one side of the support was coated with the backing layer coating solution B-I so that the dry-weight of gelatin could be 2 g/m$^2$ and, on the B-1-coated layer was simultaneously coated with a backing protective layer by making use of the protective layer coating solution P-2 so that the dry-weight of gelatin thereof could be 1 g/m$^2$, and dried. Next, on the other side of the support was coated with an emulsion layer so that the dry-weight of gelatin could be 1.8 g/m$^2$ and the amount of silver coated could 4.3 g/m$^2$ and, on the resulted emulsion layer was simultaneously coated with an emulsion protective layer by making use of the protective layer coating solution P-1 so that the dry-weight of gelatin could be 0.8 g/m$^2$, with adding formalin as a hardening agent, and dried. The resulted sample material was cut up in the conditions at 23° C. and 35% RH at a dew-point of 6° C. and was then air-tight wrapped with a non-air-permeable wrapping paper, so that Evaluation Samples No. S-1 through No. S-10 were prepared respectively. The drying conditions thereof are shown in Table-2 below.

TABLE 1

| Combination of Evaluation Samples Nos., Emulsions Used and Drying Conditions | | | | | |
|---|---|---|---|---|---|
| | | Mixing temperature | | | |
| | | 30° C. | 40° C. | 50° C. | 60° C. |
| | | Em. ctg. solution | | | |
| | | E-1 | E-2 | E-3 | E-4 |
| | | Av. AgX grain size | | | |
| Emulsion used | | 0.1μ | 0.2μ | 0.3μ | 0.4μ |
| Combination of emulsions and drying conditions. | a | S-1 | S-4 | S-10 | S-13 |
| | b | — | S-5* | — | — |
| | c | — | S-6* | — | — |
| | d | S-2* | S-7* | S-11* | S-14 |
| | e | — | S-8* | — | — |
| | f | S-3* | S-9* | S-12* | S-15 |

*Subject to the invention

DRYING CONDITIONS IN COATING PROCESS

A 35° C.-coating solution was coated on and then treated for 6 seconds by blowing the 5° C.-air so that the solution was cooled down and set. Then, the resulted coated layer was dried with keeping the temperature of the coated layer surface at 10° C. by blowing the dry air having a dry-bulb temperature of 23° C. and a relative humidity of 20%, so as to make gelatin have a moisture content of 1600%. Next, the coated layer was dried by blowing the dry air having a dry-bulb temperature of 27° C. and a relative humidity of 20%. Further, the coated layer was dried so that an average temperature of the dried coated surface could be at 33° C. by blowing the dry air having a dry-bulb temperature of 34° C. and a relative humidity of 43%. Five seconds later, the combinations of a, b, c, d, e and f were processed respectively under the conditions that a heat transmission coefficient of 100 kcal/hy.m$^2$ and the processing time for 40 seconds.

TABLE 2

| Drying conditions | Dried surface: Drying conditions applied to backing layer side | Dried surface: Drying conditions applied to emulsion layer side |
|---|---|---|
| a | Dried by the dry-air having a dry-bulb temp. of 25° C. and relative humidity of 50% (Conditions A) | The same as Condition A |
| b | The same as Condition A | The same as Condition B |
| c | Dried by the dry-air having a dry-bulb temp. of 35° C. and relative humidity of 22% (Conditions B) | The same as Condition A |
| d | The same as Condition B | The same as Condition B |
| e | Dried by the dry-air having a dry-bulb temp. of 80° C. and relative humdity of 22% (Conditions C) | The same as Condition A |
| f | The same as Condition C | The same as Condition C |

The resulted samples, were unpacked under the conditions of an environmental temperature of 23° C. and environmental relative humidity of 40% and were rehumidified for 12 hours. After then, they were subjected to the following dimensional stability test, respectively.

DIMENSIONAL STABILITY TEST

Thus rehumidified samples were scarred at intervals of 560mm at an environmental temperature of 23° C. and relative humidity of 40%. The scarred samples were processed with an automatic processor under the following processing conditions by making use of the following developer and fixer. The structure of the automatic processor is shown in FIG. 1. wherein reference numerals indicate the following items. respectively:

1 is an inserting table,
2 is a detecting-developing cross-over rack,
3 is a developing rack,
4 is a developing-fixing cross-over rack,
5 is a fixing rack,
6 is a fixing-washing cross-over rack,
7 is a washing rack,
8 is a squeezing rack,
9 is a drying rack,
10 is a guide member,
11 is a drying-and-delivering rack, and
12 is a film receiving basket. Thus processed samples were rehumidified for 12 hours under the conditions of an environmental temperature of 23° C. and relative humidity of 40% and the actual lengths of the scars left on the samples were then measured. Each value obtained by deducting the actual length of each scar from the aforegoing 560 mm was regarded as a value of dimensional stability in terms of $\mu$m unit. A positive value thereof means that a sample was lengthened by the automatic processing. The more a sample is lengthened, the more a dimensional stability is lowered. The results are shown in Table-3. Processing solutions and conditions use in the test were as follows.

COMPOSITION OF DEVELOPERS

| Developer A | |
|---|---|
| Composition A | |
| Pure water. i.e., ion-exchange water | 150 ml |
| Disodium ethylenediaminetetraacetate | 2 g |
| Diethylene glycol | 50 g |
| Potassium sulfite (in an aqueous 5% W/V solution) | 100 ml |
| Potassium carbonate | 50 g |
| Hydroquinone | 15 g |
| 5-methylbenzotriazole | 200 mg |
| 1-phenyl-5-mercaptotetrazole | 30 mg |
| Potassium hydroxide, in an amount to make pH of using developer solution to be 10.4 | |
| Potassium bromide | 4.5 g |
| Composition B | |
| Pure water, i.e., ion-exchange water | 3 ml |
| Diethylene glycol | 50 g |
| Disodium ethylenediaminetetraacetate | 25 mg |
| Acetic acid in an aqueous 90% solution | 0.3 ml |
| 5-nitroindazole | 110 mg |
| 1-phenyl-3-pyrazolidone | 500 mg |

Before using the developer, Composition A and B were dissolved in order in 500 ml of water to make one liter and the resulted developer A was then used.

COMPOSITION OF FIXER

| Composition A | |
|---|---|
| Ammonium thiosulfate in an aqueous 72.5% W/V solution | 230 ml |
| Sodium sulfite | 9.5 g |
| Sodium acetate, trihydrate | 15.9 g |
| Boric acid | 6.7 g |
| Sodium citrate, dihydrate | 2 g |
| Acetic acid, in an aqueous 90% W/W solution | 8.1 ml |
| Composition B | |
| Pure water. i.e., ion-exchange water | 17 ml |
| Sulfuric acid, in an aqueous 50% W/W solution | 5.8 g |
| Aluminium sulfate, in an aqueous solution having a 8.1% W/W in terms of $Al_2O_3$ | 26.5 g |

Before using, the above-given composition A and B were dissolved in order in 500 ml of water to make one liter and the resulted fixer was then used. The pH of this fixer was about 4.3.

PROCESSING CONDITIONS

| Step | Temp. | Time | Tank capacity |
|---|---|---|---|
| Developing | 28° C. | 30 sec. | 20 liters |
| Fixing | 28° C. | 20 sec. | 20 liters |
| Washing | 18° C. | 20 sec. | 15 liters |
| Drying | 40° C. | 25 sec. | 20 liters |
| Heat transmission coefficient of a dryer: 95 kcal/hr · $m^2$ · °C. | | | |
| Environmental temperature and relative humidity of an automatic processor installed: 23° C. and 40% RH | | | |

Environmental temperature and relative humidity of an automatic processor installed: 23° C. and 40%RH The processing time of each processing step includes the time required for transporting film through the so-called cross-over sections between the respective processing steps.

Time required for dry-to-dry: 85 seconds

Line speed: 1500 mm per minute

TABLE 3

| Sample No. | AgX grain size, μm | Coating drying conditions | Pre-, post-processing dimensional stability | Subject to Inv. or comparison |
|---|---|---|---|---|
| S-13 | 0.4 | a | +82 | Comp. |
| S-10 | 0.3 | a | +80 | Comp. |
| S-4 | 0.2 | a | +85 | Comp. |
| S-1 | 0.1 | a | +81 | Comp. |
| S-14 | 0.4 | d | +80 | Comp. |
| S-15 | 0.4 | f | +83 | Comp. |
| S-11 | 0.3 | d | +12 | Inv. |
| S-7 | 0.2 | d | +2 | Inv. |
| S-2 | 0.1 | d | +4 | Inv. |
| S-12 | 0.3 | f | +2 | Inv. |
| S-9 | 0.2 | f | −4 | Inv. |
| S-9 | 0.1 | f | −1 | Inv. |
| S-5 | 0.2 | b | +7 | Inv. |
| S-6 | 0.2 | c | +15 | Inv. |
| S-8 | 0.2 | e | +12 | Inv. |

Inv. . . . Samples relating to the invention
Comp. . . . Samples other than the invention As is obvious from the results shown in Table-3, an excellent dimensional stability cannot be provided unless an average grain size of silver halide is not larger than 0.3 μ and, at the same time, the drying conditions, b, c, d, e or f corresponding to the conditions of the invention are applied. It is found that, when an average grain size of silver halide is 0.4 μ, any effect cannot be observed even if the drying conditions are changed and the dimensional stability is also deteriorated. When applying the coating and drying conditions to a backing layer side or an emulsion layer side, that is, in the cases of S 5 or S-6 and S-8, a good effect can also be enjoyed. However, the most excellent results can be obtained when applying the drying conditions of this embodiment to both of the emulsion side and the backing side, that is, in the cases of S-7 and S-9.

EXAMPLE-2

The following samples were prepared by applying the same drying conditions as in Example-1, except that the polymer latex contents of the coating solution E-2 of Example-1 were changed, and thus prepared samples were subjected to the same dimensional stability test as that tried in Example-1.

Further, the transmission density of each sample was measured by making use of a Konica Densitometer, PDA-65, in such a manner that the samples were exposed to light for 8 seconds with bringing the emulsion side of each sample into close contact with the glass plate of a roomlight type printer, P-627FM manufactured by Dainippon Screen Mfg. Co., and process in the aforementioned manner.

| Sample evaluated | S-16 | S-17 | S-18 | S-19 |
|---|---|---|---|---|
| Polymer latex content (g/$m^2$) | 0 | 0.5 | 8 | 12 |

TABLE 4

| Sample No. | Results of measurements: Dimensional stability | Density |
|---|---|---|
| S-16 | +15μ | 5.8 |
| S-17 | −1μ | 5.9 |
| S-18 | ±0μ | 5.5 |
| S-19 | −1μ | 4.3 |

As is obvious from Table-4, it can be observed that the samples each containing polymer latex, e.g., S-17, S-18 and S-19, are more excellent in dimensional stability than the samples each not containing any of them, e.g., S-16, and that the samples containing the same in an amount of exceeding 10 g/$m^2$, e.g., S-19, are lower in density than the samples, e.g., S-16, S-17 and S-18.

EXAMPLE-3

In this example, positive type silver halide light-sensitive material were prepared in the following manner.

An aqueous gelatin solution having a pH of 2 and having been kept at 55° C. was mixed with both of an aqueous gelatin solution containing a sodium hexachlororhodate in an amount of 25 mg per mol of silver and 2.5 mols of potassium bromide and an aqueous solution containing 2.5 mols of silver bromide, by taking 70 minutes in a double-jet precipitation method, provided that an amount of ions was so adjusted as to satisfactorily growing the grains while controlling a silver electrode potential and a pH to keep at 140 mV and pH=2, respectively.

At the time when the above-mentioned mixture was completed, the pH was adjusted to be 5.5 and water-soluble salts were removed in an ordinary coagulation method and, further, gelatin was added, so that a monodisperse type silver bromide emulsion having an average grain size of 0.2 μm was prepared.

PREPARATION OF EMULSION $E_1$

The resulted monodisperse type silver bromide emulsion was added with sodium carbonate and the pH was adjusted to be 7.5. Then, the resulted matter was added with thiourea dioxide in an amount of 12 mg per mol of silver halide and was then fogged by ripening at 65° C. until the maximum characteristics was displayed. After then, the ripened emulsion was cooled down to 40° C. and added with chloroauric acid in an amount of 6 mg per mol of silver halide, so that Emulsion E-1 was prepared.

PREPARATION OF PROTECTIVE LAYER COATING SOLUTION

Protective layer coating solution P-3 was prepared in the following manner.

Pure water of 10 liters were added into 1 kg of gelatin. After the gelatin was swollen, the mixture was dissolved with heating. The resulted solution was added with 66 g of the following compound Q-2 as a dye, 500 ml of an aqueous solution of the following compound Q-1 as a coating aid, 10 g of amorphous silica gel having an average particle size of 8 μm as a matting agent, gelatin upon dispersion thereof, and 10 g of the following compound Q-3 as a dye, so that the protective layer coating solution P-3 was prepared.

Compound Q-1

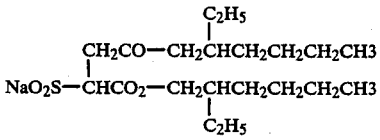

Compound Q-2

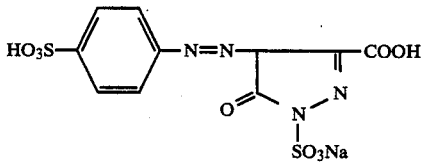

Compound Q-3

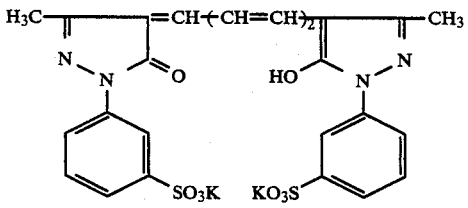

PREPARATION OF EMULSION COATING SOLUTION $E_2$

Emulsion coating solution $E_2$ was prepared in the following manner.

Emulsion $E_1$ was added with the following compound Q-4 in an amount of 560 mg per mol of silver halide and the following compound Q-5 in an amount of 250 mg per mol of silver halide. The resulted mixture was then added with saponin in an amount of 3.9 g, and the aforegoing compound C-4, a latex polymer in an amount of 280 mg and dextrin in an amount of 5.6 g, each per mol of silver halide. After then, while adjusting the viscosity of the resulted matter at 35° C. with a thickening agent so to be 15 CP, the emulsion coating solution $E_2$ was prepared.

Compound Q-4

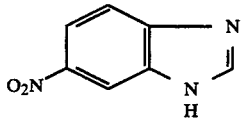

Compound Q-5

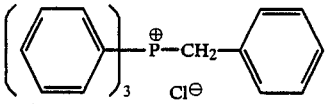

PREPARATION OF BACKING LAYER COATING SOLUTION B-2

The coat solution B-2 was prepared in the same manner as in the backing layer coating solution B-1, except that phenidone was added in an amount of 5 mg per gram of gelatin in place of Compound C-6 and pH was adjusted to be 5.4 with citric acid.

PREPARATION OF PROTECTIVE LAYER COATING SOLUTION P-4 FOR BACKING LAYER

The protective layer coating solution P-4 was prepared in the same manner as in the foregoing protective layer coating solution P-2 , except that mucochloric acid was not added.

PREPARATION OF SAMPLES FOR EVALUATION

The above-mentioned coating solutions were combined as shown in Table-5. The combination thereof was coated on one side after another of the both sides of a 100 μm-thick polyethylene terephthalate film support provided thereon with an under-coat layer described in Example-1 of Japanese Patent O.P.I. Publication No. 59-09941 (1984), so that the samples for evaluation shown in Table-5 were prepared. In the preparation thereof, on one side of the support provided with the under-coat layer was coated with a backing under-coat layer by making use of the coating solution B-2 so that the dry-weight of gelatin could be 2 g/m$^2$ and, further, on the backing under-coat layer was coated with a backing protective layer by making use of the protective layer coating solution P-4 so that the dry-weight of gelatin could be 1 g/m$^2$, and each of them were then simultaneously dried. Next, the samples for evaluation. N-1 through N-13, were prepared in the following manner. On the other side of the support was coated with an emulsion layer by making use of the emulsion coating solution $E_1$ so that the dry-weight of gelatin could be 1.5 g/m and the amount of silver coated could be 4.3 g/m$^2$. At the same time when the emulsion layer was coated on, a emulsion protective layer was further coated on the emulsion layer by making use of protective layer coating solution P-3 so that the dry-weight of gelatin could be 1 g/m$^2$ with adding formalin as a hardener, and both of them were then dried.

The drying conditions for the preparation are shown in Table-5.

COATING AND DRYING CONDITIONS

A 35° C.-coating solution was coated on and then treated for 7 seconds by blowing the 5° C.-air so that the solution was cooled down and set. Then, the resulted coated layer was dried with keeping the temperature of the coated layer surface at 10° C. by blowing the dry air having a dry-bulb temperature of 23° C. and a relative humidity of 20%, so as to make gelatin have a moisture content of 1600%. Next, the coated layer was dried by blowing the dry air having a dry-bulb temperature of 27° C. and a relative humidity of 20%, so as to make gelatin have a moisture content of 1000%, while keeping the coated surface temperature at 13.8° C. The resulted sample was sectionalized into 14 portions and dried under the drying conditions shown in Table-4, so that Samples S-11 through S-24 were prepared. In addition, the same drying conditions were applied to both of the emulsion side and the backing layer side.

TABLE 5

| Sample No. | Drying conditions for the case of average temp. of coated surface: Drying condition 1* | Drying condition 2** | Remark |
|---|---|---|---|
| N-1 | Dry-bulb temp.: 25° C.<br>Rel. humidity: 50% | Dry-bulb temp. 25° C.<br>Rel. humidity: 50%<br>Drying time: 30 sec. | Comp. |
| N-2 | Dry-bulb temp.: 40° C.<br>Rel. humidity: 22% | Dry-bulb temp. 25° C.<br>Rel. humidity: 50%<br>Drying time: 30 sec. | Comp. |
| N-3 | Dry-bulb temp.: 25° C.<br>Rel. humidity: 50% | Dry-bulb temp. 40° C.<br>Rel. humidity: 22%<br>Drying time: 30 sec. | Inv. |
| N-4 | Dry-bulb temp.: 25° C.<br>Rel. humidity: 50% | Dry-bulb temp. 40° C.<br>Rel. humidity: 22%<br>Drying time: 2 min. | Comp. |
| N-5 | Dry-bulb temp.: 25° C.<br>Rel. humidity: 50% | Dry-bulb temp. 40° C.<br>Rel. humidity: 22%<br>Drying time: 1 min. | Inv. |
| N-6 | Dry-bulb temp.: 25° C.<br>Rel. humidity: 50% | Dry-bulb temp. 40° C.<br>Rel. humidity: 22%<br>Drying time: 15 sec. | Inv. |
| N-7 | Dry-bulb temp.: 25° C.<br>Rel. humidity: 50% | Dry-bulb temp. 40° C.<br>Rel. humidity: 22%<br>Drying time: 5 sec. | Inv. |
| N-8 | Dry-bulb temp.: 25° C.<br>Rel. humidity: 50% | Dry-bulb temp. 40° C.<br>Rel. humidity: 22%<br>Drying time: 2 sec. | Comp. |
| N-9 | Dry-bulb temp.: 40° C.<br>Rel. humidity: 22% | Dry-bulb temp. 40° C.<br>Rel. humidity: 22%<br>Drying time: 30 sec. | Inv. |
| N-10 | Dry-bulb temp.: 34° C.<br>Rel. humidity: 43% | Dry-bulb temp. 70° C.<br>Rel. humidity: 5%<br>Drying time: 30 sec. | Inv. |
| N-11 | Dry-bulb temp.: 34° C.<br>Rel. humidity: 43% | Dry-bulb temp. 50° C.<br>Rel. humidity: 5%<br>Drying time: 30 sec. | Inv. |
| N-12 | Dry-bulb temp.: 34° C.<br>Rel. humidity: 43% | Dry-bulb temp. 25° C.<br>Rel. humidity: 5%<br>Drying time: 30 sec. | Inv. |
| N-13 | Dry-bulb temp.: 34° C.<br>Rel. humidity: 43% | Dry-bulb temp. 70° C.<br>Rel. humidity: 5%<br>Drying time: 30 sec. | Comp. |

Drying condition 1*: Condition before average temperature of the coating surface reaches to a value of 1° C. lower than average temperature of the drying air.
Drying condition 2**: Condition after average temperature of the coating surface reaches to a value of 1° C. lower than average temperature of the drying air.

Sample N-1 was further multi-sectionalized and one portion thereof was taken. Four minutes after the point of time when an average coated surface temperature of the portion became 1° C. lower than the average drying air temperature, this portion was dried at a dry-bulb temperature of 40° C. and relative humidity of 50% by taking 30 seconds. The resulted sample was named N-14. Similarly to the above, another portion thereof was taken and five minutes after the point of time when an average coated surface temperature of the portion became 1° C. lower than the average drying air temperature, this portion was dried at a dry-bulb temperature of 40° C. and relative humidity of 50% by taking 30 seconds. The resulted sample was named N-15.

Samples N-1 through N-15 were cut into a size and packed under the conditions at 23° C. and 35% RH.

were

On the other hand, Samples R-1 through R-15 prepared by coating, drying, cutting and packing, respectively, in quite the same manner as in the above-mentioned samples, except that the emulsion coating solution $E_2$ was used.

Further, Samples T-1 through T-15 were prepared in such a manner that the samples, which had been treated under the same emulsion preparing conditions and in the same coating and drying processes each as in the samples N-1 throught N-15, were handled under the conditions at 23° C. and 80% RH i.e., at a dew-point of 19° C. from the point of time when the coating and drying process was completed to the packing process.

With respect to these groups of samples, the dimensional stability tests were tried and the surface cracks of their undeveloped samples were inspected, in the same manners as in Example-1. The cracks were inspected by observing the surface conditions by the eye. The cracks were graded by 5 levels, i.e., levels 5 and 4 have no problem, level 3 is acceptable on the market and levels 2 and 1 are impossible to commercialize. The results are shown in Table-6.

TABLE 6

| Sample No. Inv. or Comp. | (Part 1) Dimensional stability (μ) | Crack (in grade) |
|---|---|---|
| N-1 (Comp.) | +91 | 5 |
| N-2 (Comp.) | +94 | 5 |
| N-3 (Inv.) | +10 | 5 |
| N-4 (Comp.)* | +13 | 5 |
| N-5 (Inv.) | +8 | 5 |
| N-6 (Inv.) | +9 | 5 |
| N-7 (Inv.) | +20 | 5 |
| N-8 (Comp.) | +80 | 5 |
| N-9 (Inv.) | +10 | 5 |
| N-10 (Inv.) | −10 | 3 |
| N-11 (Inv.) | −12 | 5 |
| N-12 (Inv.) | −10 | 5 |
| N-13 (Comp.) | +61 | 5 |
| N-14 (Inv.) | +31 | 1 |

TABLE 6-continued

| | | |
|---|---|---|
| N-15 (Comp.) | +95 | 5 |

(Part 2)

| Sample No. Inv. or Comp. | Dimensional stability (μ) | Crack (in grade) |
|---|---|---|
| R-1 (Comp.) | +92 | 5 |
| R-2 (Comp.) | +89 | 5 |
| R-3 (Inv.) | +19 | 5 |
| R-4 (Comp.)* | +8 | 5 |
| R-5 (Inv.) | +4 | 5 |
| R-6 (Inv.) | +2 | 5 |
| R-7 (Inv.) | +0 | 5 |
| R-8 (Comp.) | +78 | 5 |
| R-9 (Inv.) | +2 | 5 |
| R-10 (Inv.) | −11 | 5 |
| R-11 (Inv.) | −9 | 5 |
| R-12 (Inv.) | −8 | 5 |
| R-13 (Comp.) | +63 | 2 |
| R-14 (Inv.) | +22 | 5 |
| R-15 (Comp.) | +90 | 5 |

(Part 3)

| Sample No. Inv. or Comp. | Dimensional stability (μ) | Crack (in grade) |
|---|---|---|
| T-1 (Comp.) | +115 | 5 |
| T-2 (Comp.) | +111 | 5 |
| T-3 (Inv.) | +38 | 5 |
| T-4 (Comp.) | +26 | 5 |
| T-5 (Inv.) | +21 | 5 |
| T-6 (Inv.) | +19 | 5 |
| T-7 (Inv.) | +14 | 5 |
| T-8 (Comp.) | +16 | 5 |
| T-9 (Inv.) | +100 | 5 |
| T-10 (Inv.) | +24 | 3 |
| T-11 (Inv.) | +11 | 5 |
| T-12 (Inv.) | +8 | 5 |
| T-13 (Comp.) | +85 | 1 |
| T-14 (Inv.) | +41 | 5 |
| T-15 (Comp.) | +123 | 5 |

*N-4 and R-4 each caused fixing faults under the fixing conditions at 28° C. for 20 seconds.

As is obvious from the results shown in Table-6, the following facts were verified:

Before an average surface temperature becomes 1° C. lower than an average drying temperature, the drying conditions cannot give any special effect to both of dimensional stability and fixability, but can give good effects, provided only that the conditions can satisfy the conditions of the invention after the average surface temperature reached 1° C. lower than the average drying air temperature;

When a drying is carried out by blowing the drying air having a temperature of from 35° C. to 80° C. or a relative humidity of from 5% to 25% for a period of from 5 seconds to one minute after an average coated surface temperature become 1° C. lower than an average drying air temperature, a desirable effect can be obtained. However, if the blowing time is shorter than the above, the dimensional stability effects may be diminished and, on the other hand, if it is blown for 2 minutes, a fixing fault may be produced;

Those containing polymer latex are excellent in dimensional stabilities between pre- and post-processing as well as in physical properties:

The advantages of the coating and drying conditions of the invention can more preferably be displayed by carrying out a series of the manufacturing processes from the point of time when a drying step is completed to a point of time when a packing step is completed, under the conditions of a dew-point of not higher than 16° C; and, The dry air may be specified by either relative humidity or temperature. However, a relative humidity required for the conditions of the invention may be obtained by either raising a drying air temperature or lowering a wet-bulb temperature of the drying air.

EXAMPLE-4

Negative type silver halide light-sensitive materials were prepared so as to serve as roomlight contact type light-sensitive material, in the following manner.

PREPARATION OF EMULSIONS

In the following manner, silver chlorobromide emulsions each having a silver bromide content of 2 mol% were prepared.

Silver chlorobromide emulsions having average grain sizes of 0.10 μm, 0.20 μm, 0.30 μm and 0.40 μm were prepared respectively in the same manner as Example 1.

PREPARATION OF EMULSION COATING SOLUTIONS

Emulsion coating solutions E-1 through E-5 each shown in Table-1 were prepared in the following manner.

After each of the aforementioned emulsion solutions was added with 9 mg of the following Compound K as a pasteurizer, the pH of the resulted solution was adjusted to be 6.5 with a 0.5 normal sodium hydroxide solution and was then added with tetrazolium compound T as a contrast hardening agent in an amount of $0.4\times10-3$ mol or $4\times10^{-3}$ mol per mol of silver and, further, with 5 ml of a 20% aqueous saponin solution, 180 mg of sodium dodecylbenzenesulfinate, 80 mg of 5-methylbenzteriazole, 43 ml of the above-mentioned latex solution L for adding emulsion solution, 60 mg of the following Compound M and 280 mg of an aqueous polymer of a styrene-maleic acid copolymer in order. The resulted matter was added with water to make 475 ml. On the other hand, the emulsion coating solutions E-6 through E-10 each shown in Table-7 were prepared by adding hydrazine compound H as a contrast hardening agent in an amount of $0.4\times10^{-4}$ mol or $4\times10^{-4}$ mol per mol of silver in place of the terazolium compound T.

Compound K

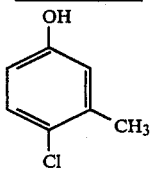

Also, emulsion coating solutions E-11 through E-15 each shown in Table-1 were prepared by adding polyalkylene oxide compound P in an amount of $0.1\times10^{-4}$ mol or $1\times10^{-4}$ mol per mol of silver in place of the tetrazolium compound T.

Further, an emulsion coating solution E-16 shown in Table-1 was prepared without adding any contrast hardening agent.

Next, an emulsion protective layer coating solution was prepared in the following manner.

PREPARATION OF EMULSION-PROTECTIVE LAYER COATING SOLUTION P-1

The solution P-1 was prepared in the same manner as P-1 in Example 1.

Compound T

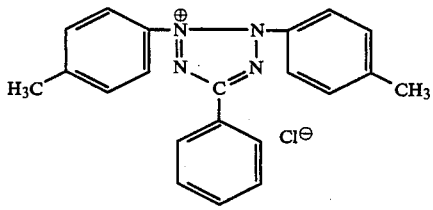

Compound H

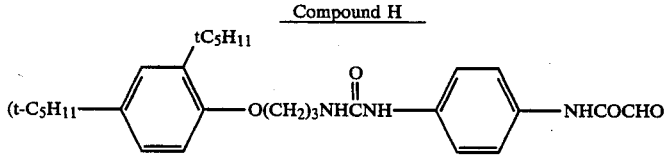

Compound P

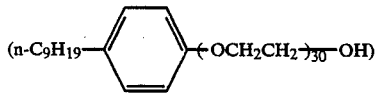

Next, a backing layer coating solution applied to coat a backing under-coat layer was prepared in the following manner.

PREPARATION OF BACKING LAYER COATING SOLUTION B-1

The solution B-1 was prepared in the same manner as solution B-1 in Example 1.

Next, Protective layer coating solution P-2 for coating a protective layer of a backing layer was prepared in the following manner.

PREPARATION OF PROTECTIVE LAYER COATING SOLUTION P-2

The coating solution P-2 was prepared in the same manner as solution P-2 in Example 1.

TABLE 7

| Contrast hardener | | | | | |
|---|---|---|---|---|---|
| | Amt. added | Grain size | | | |
| Compound | Mol/AgI mol | 0.1μ | 0.2μ | 0.3μ | 0.4μ |
| T | $0.4 \times 10^{-3}$ | | E-1 | | |
| | $4.0 \times 10^{-3}$ | E-2 | E-3 | E-4 | E-5 |
| H | $0.4 \times 10^{-4}$ | | E-6 | | |
| | $4.0 \times 10^{-4}$ | E-7 | E-8 | E-9 | E-10 |
| P | $0.1 \times 10^{-4}$ | | E-11 | | |
| | $1.0 \times 10^{-4}$ | E-12 | E-13 | E-14 | E-15 |
| — | — | | E-16 | | |

PREPARATION OF SAMPLES FOR EVALUATION USE

Each of the foregoing coating solutions was coated, in combination shown in Table-7, on one side after another of both sides of a 100 μm-thick polyethylene terephthalate film support provided thereto with such an under-coat layer as described in Example-1 of Japanese Patent O.P.I. Publication No. 59-09941 (1984), so that each of the samples for evaluation use was prepared. In this preparation process, on one side of the support was coated with the backing layer coating solution B-1 so that the dry-weight of gelatin could 2 g/m$^2$ and, on the B-1-coated layer was further coated with a backing protective layer by making use of the protective layer coating solution P-2 so that the dry-weight of gelatin thereof could be 1 g/m$^2$, and dried. Next, on the other side of the support was coated with an emulsion layer so that the dry-weight of gelatin could be 1.8 g/m$^2$ and the amount of silver coated could be 4.3 g/m$^2$ and, on the resulted emulsion layer was further coated with an emulsion protective layer by making us of the protective layer coating solution P-1 so that the dry-weight of gelatin could be 0.8 g/m$^2$, with adding formalin as a hardening agent, and dried.

The drying conditions thereof are shown in Table-8.

According to the combinations of the emulsion coating solutions used and the drying conditions shown in Table-8, the samples are designated as, for example, E-3b which means the sample prepared by making use of the emulsion coating solution E-3 shown in Table-7 and by drying it under the drying conditions b shown in Table-8, and so forth.

DRYING AND COATING CONDITIONS

A 35° C.-coating solution was coated on and then treated for 7 seconds by blowing the 5° C.-air so that the solution was cooled down and coagulated. Then, the resulted coated layer was dried with keeping the temperature of the coated layer surface at 10° C. by blowing the dry air having a dry-bulb temperature of 23° C. and a relative humidity of 20%, so as to make gelatin have a moisture content of 1600%.

Next, the resulted coated layer was dried with keeping the temperature of the coated layer Surface at 13.8° C. by blowing the dry air having a dry-bulb temperature of 27° C. and a relative humidity of 20%, so as to make gelatin have a moisture content of 1000%.

The resulted sample was sectionalized into 15 portions and dried under the drying conditions shown in Table-5, so that samples were prepared. In addition, the same drying conditions were applied to both of the emulsion side and the backing layer side.

The sample dried under Condition a was further sectionalized into 3 portions and one portion thereof was taken. Four minutes after the point of time when an average coated surface temperature of the portion became 1° C. lower than the average drying air temperature, this portion was dried at a dry-bulb temperature of 40° C. and relative humidity of 22% by taking 30 seconds. The above-given drying conditions are designated as n. Similarly to the above, another portion thereof was taken and five minutes after the point of time when an average coated surface temperature of the portion became 1° C. lower than the average drying air temperature, this portion was dried at a dry-bulb temperature of 40° C. and relative humidity of 22% by taking 30 seconds. The drying conditions are designated as P. The drying condistions n are for the invention and those P are for the comparative purpose.

TABLE 8

| Drying conditions | Drying conditions for the case of average temp. of coated surface: Drying condition 1* | Drying conditions 2** | Remark |
|---|---|---|---|
| a | Dry-bulb temp.: 25° C.<br>Rel. humidity: 50% | Dry-bulb temp. 25° C.<br>Rel. humidity: 50%<br>Drying time: 30 sec. | Comp. |
| b | Dry-bulb temp.: 40° C.<br>Rel. humidity: 22% | Dry-bulb temp. 25° C.<br>Rel. humidity: 50%<br>Drying time: 30 sec. | Comp. |
| c | Dry-bulb temp.: 25° C.<br>Rel. humidity: 50% | Dry-bulb temp. 40° C.<br>Rel. humidity: 22%<br>Drying time: 30 sec. | Inv. |
| d | Dry-bulb temp.: 25° C.<br>Rel. humidity: 50% | Dry-bulb temp. 40° C.<br>Rel. humidity: 22%<br>Drying time: 2 min. | Comp. |
| e | Dry-bulb temp.: 25° C.<br>Rel. humidity: 50% | Dry-bulb temp. 40° C.<br>Rel. humidity: 22%<br>Drying time: 1 min. | Inv. |
| f | Dry-bulb temp.: 25° C.<br>Rel. humidity: 50% | Dry-bulb temp. 40° C.<br>Rel. humidity: 22%<br>Drying time: 15 sec. | Inv. |
| g | Dry-bulb temp.: 25° C.<br>Rel. humidity: 50% | Dry-bulb temp. 40° C.<br>Rel. humidity: 22%<br>Drying time: 5 sec. | Inv. |
| h | Dry-bulb temp.: 25° C.<br>Rel. humidity: 50% | Dry-bulb temp. 40° C.<br>Rel. humidity: 22%<br>Drying time: 2 sec. | Comp. |
| i | Dry-bulb temp.: 40° C.<br>Rel. humidity: 22% | Dry-bulb temp. 40° C.<br>Rel. humidity: 22%<br>Drying time: 30 sec. | Inv. |
| j | Dry-bulb temp.: 34° C.<br>Rel. humidity: 43% | Dry-bulb temp. 70° C.<br>Rel. humidity: 5%<br>Drying time: 30 sec. | Inv. |
| k | Dry-bulb temp.: 34° C.<br>Rel. humidity: 43% | Dry-bulb temp. 50° C.<br>Rel. humidity: 5%<br>Drying time: 30 sec. | Inv. |
| l | Dry-bulb temp.: 34° C.<br>Rel. humidity: 43% | Dry-bulb temp. 25° C.<br>Rel. humidity: 5%<br>Drying time: 30 sec. | Inv. |
| m | Dry-bulb temp.: 34° C.<br>Rel. humidity: 43% | Dry-bulb temp. 50° C.<br>Rel. humidity: 3%<br>Drying time: 30 sec. | Comp. |

Drying condition 1*: Condition before average temperature of the coating surface reaches to a value of 1° C. lower than average temperature of the drying air.
Drying condition 2**: Condition after average temperature of the coating surface reaches to a value of 1° C. lower than average temperature of the drying air.

The samples thus prepared were rehumidified for 12 hours under the conditions at an environmental temperature of 23° C. and an environmental relative humidity of 40% and were then subjected to the following dimensional stability tests, the tests for fixing clearness time required and the sensitometric tests, respectively.

The following three types of developers were selectively used according to the combination thereof with contrast hardening agents added thereto. Namely, Developer A was used to develop the samples added with a tetrazolium compound, Developer B to those with a hydrazine compound and Developer C to those with a polyalkylene oxide compound, respectively. It has been well-known that these combinations are desirable, according to the descriptions of, for example, Japanese Patent O.P.I. Publication No. 62-210458 (1987) and so forth and those combined developers are now available as the systems on the market from various manufacturers. Further, the following fixers and the automatic processors such as that shown in Fig. 1 were used. With this type of automatic processors, the line-speeds can be variable and the total processing time can also be controllable.

In this example, the two types of rapid processes were carried out, i.e., one was carried out under the processing conditions shown in Tables 9-1 to 9-3 which are the standard conditions for the combinations, provided that the fixing temperature and time were as same as those for developing process, and the other was carried out by taking a total processing time of 50 seconds including 15 seconds for developing and 15 seconds for fixing. The results obtained from each processing are shown in Tables 9-1 through 9-3, respectively.

DIMENSIONAL STABILITY TEST

Thus rehumidified samples were scarred at intervals of 560 mm at an environmental temperature of 23° C. and relative humidity of 40%. The scarred samples were processed with an automatic processor under the following processing conditions by making use of the following developer and fixer. Thus processed samples were rehumidified for 12 hours under the conditions of an environmental temperature of 23° C. and relative humidity of 40% and the actual lengths of the scars left on the samples were then measured. Each value obtained by deducting the actual length of each scar from the aforegoing 560 mm was regarded as a value of dimensional stability in terms of μm unit. A positive value thereof means that a sample was lengthened by the automatic processing. The more a sample is lengthened, the more a dimensional stability is lowered.

TEST FOR FIXING CLEARNESS TIME REQUIRED

This tests was made by measuring a period of time from when dipping each sample in one liter of the above-mentioned fixer having a temperature of 34° C. until when the sample became transparent. The test results were expressed in terms of seconds. The less the seconds are, the more the fixing property is excellent.

SENSITOMETRIC TEST

Each of the above-mentioned samples was exposed to light through a glass-made wedge by making use of a roomlight type printer P-627FM manufactured by Dainippon Screen Mfg. Co. to which an electrodeless discharge tube manufactured by Fusion Co. of the U.S.A. was mounted.

COMPOSITION OF DEVELOPERS

Developer A: the same as mentioned in Example 1.

Developer B

| | |
|---|---|
| Hydroquinone | 45.0 g |
| N-methyl-p-aminophenol ½ sulfate | 0.8 g |
| Sodium hydroxide | 15.0 g |
| Potassium hydroxide | 55.0 g |
| 5-sulfosalicylic acid | 45.0 g |
| Boric acid | 35.0 g |
| Potassium sulfite | 110.0 g |

-continued

| | |
|---|---|
| Disodium ethylenediaminetetraacetate | 1.0 g |
| Potassium bromide | 6.0 g |
| 5-methylbenzotriazole | 0.6 g |
| n-butyl-diethanolamine | 15.0 g |
| Add water to make | 1 liter |
| Adjust pH to be | pH = 11.6 |

Developer C A rapid lith developer, CDL-271 AB manufactured by Konica Corporation, was used.

COMPOSITION OF FIXER

Composition A: The same as mentioned in Example 1.

RAPID PROCESSING CONDITIONS

| step | Temperature | Time | Tank capacity |
|---|---|---|---|
| Developing | 35° C. | 15 sec. | 20 or 40 ltr. |
| Fixing | 34° C. | 15 sec. | 20 ltr. |
| Washing | 18° C. | 10 sec. | 10 or 20 ltr. |
| Drying | 40° C. | 10 sec. | 20 ltr. |

Heat transmittance coefficient of a dryer: 180 Kcal/h · $m^2$ · °C.
Environmental temperature and relative humidity of an automatic processor installed: 23° C. and 40% RH The processing time of each processing step includes the time required for transporting film through the so-called cross-over sections between the respective processing steps.

| | |
|---|---|
| Time required for dry-to-dry: | 50 seconds |
| Line speed: | 3000 mm per minute |

TABLE 9

| | | | | | Standard processing | | | | Rapid processing | | | |
|---|---|---|---|---|---|---|---|---|---|---|---|---|
| Sample No. | Grain size μm | Contrast hardener | Amount added, in mol/Ag mol | Developer | Developing conditions | Dimensional stability | Fixing clearness | γ | Dimensional stability | γ | Overall evaluation* | Invention** |
| E3-a | 0.2 | T | $4 \times 10^{-3}$ | (A) | 28° C. 30″ | +83 μm | 13″ | 10.2 | +90 μm | 9.0 | N.G. | Comp. |
| E3-b | ″ | ″ | ″ | ″ | ″ | +82 μm | 12″ | 10.3 | +91 μm | 8.9 | N.G. | Comp. |
| E3-c | ″ | ″ | ″ | ″ | ″ | +6 μm | 12″ | 10.2 | +9 μm | 9.1 | G. | Inv. |
| E3-d | ″ | ″ | ″ | ″ | ″ | +76 μm | 12″ | 10.1 | +86 μm | 9.2 | N.G. | Comp. |
| E3-e | ″ | ″ | ″ | ″ | ″ | +8 μm | 13″ | 10.0 | +13 μm | 9.1 | G. | Inv. |
| E3-f | ″ | ″ | ″ | ″ | ″ | +10 μm | 12″ | 10.4 | +14 μm | 9.3 | G. | Inv. |
| E3-g | ″ | ″ | ″ | ″ | ″ | +9 μm | 12″ | 10.2 | +12 μm | 9.2 | G. | Inv. |
| E3-h | ″ | ″ | ″ | ″ | ″ | +91 μm | 12″ | 10.5 | +92 μm | 9.1 | N.G. | Comp. |
| E3-i | ″ | ″ | ″ | ″ | ″ | +8 μm | 13″ | 10.2 | +10 μm | 9.0 | G. | Inv. |
| E3-j | ″ | ″ | ″ | ″ | ″ | +9 μm | 12″ | 10.2 | +13 μm | 8.8 | G. | Inv. |
| E3-k | ″ | ″ | ″ | ″ | ″ | +9 μm | 12″ | 10.1 | +12 μm | 9.7 | G. | Inv. |
| E3-l | ″ | ″ | ″ | ″ | ″ | +8 μm | 13″ | 10.0 | +10 μm | 9.6 | G. | Inv. |
| E3-m | ″ | ″ | ″ | ″ | ″ | +79 μm | 12″ | 10.3 | +85 μm | 9.4 | N.G. | Comp. |
| E3-n | ″ | ″ | ″ | ″ | ″ | +11 μm | 12″ | 10.4 | +14 μm | 9.2 | G. | Inv. |
| E3-p | ″ | ″ | ″ | ″ | ″ | +74 μm | 12″ | 10.2 | +86 μm | 9.1 | N.G. | Comp. |
| E8-a | ″ | H | $4 \times 10^{-4}$ | (B) | 38° C. 20″ | +80 μm | 13″ | 11.2 | +90 μm | 9.6 | N.G. | Comp. |
| E8-b | ″ | ″ | ″ | ″ | ″ | +81 μm | 12″ | 11.4 | +93 μm | 9.2 | N.G. | Comp. |
| E8-c | ″ | ″ | ″ | ″ | ″ | +9 μm | 12″ | 11.3 | +14 μm | 9.4 | G. | Inv. |
| E8-d | ″ | ″ | ″ | ″ | ″ | +83 μm | 11″ | 11.4 | +90 μm | 9.3 | N.G. | Comp. |
| E8-e | ″ | ″ | ″ | ″ | ″ | +10 μm | 13″ | 11.2 | +12 μm | 9.4 | G. | Inv. |
| E8-f | ″ | ″ | ″ | ″ | ″ | +11 μm | 12″ | 11.2 | +14 μm | 9.9 | G. | Inv. |
| E8-g | ″ | ″ | ″ | ″ | ″ | +8 μm | 12″ | 11.3 | +10 μm | 9.2 | G. | Inv. |
| E8-h | ″ | ″ | ″ | ″ | ″ | +78 μm | 11″ | 11.3 | +87 μm | 9.0 | N.G. | Comp. |
| E8-i | ″ | ″ | ″ | ″ | ″ | +10 μm | 12″ | 11.4 | +13 μm | 9.8 | G. | Inv. |
| E8-j | ″ | ″ | ″ | ″ | ″ | +9 μm | 13″ | 11.5 | +12 μm | 9.2 | G. | Inv. |
| E8-k | ″ | ″ | ″ | ″ | ″ | +8 μm | 13″ | 10.9 | +10 μm | 9.6 | G. | Inv. |
| E8-l | ″ | ″ | ″ | ″ | ″ | +8 μm | 12″ | 11.2 | +10 μm | 9.2 | G. | Inv. |
| E8-m | ″ | ″ | ″ | ″ | ″ | +76 μm | 12″ | 11.3 | +83 μm | 9.3 | N.G. | Comp. |
| E8-n | ″ | ″ | ″ | ″ | ″ | +10 μm | 12″ | 11.5 | +12 μm | 9.4 | G. | Inv. |

TABLE 9-continued

| Sample No. | Grain size μm | Contrast hardener | Amount added, in mol/Ag mol | Developer | Standard processing: Developing conditions | Standard processing: Dimensional stability | Standard processing: Fixing clearness | Standard processing: γ | Rapid processing: Dimensional stability | Rapid processing: γ | Rapid processing: Overall evaluation* | Invention** |
|---|---|---|---|---|---|---|---|---|---|---|---|---|
| E8-p | " | " | " | " | " | +81 μm | 12" | 11.2 | +89 μm | 9.7 | N.G. | Comp. |

*G . . . Good,
N.G. . . . Not good
**Comp. . . . Comparative,
Inv. . . . Invention As is obvious from Tables 9-1 through 9-3, only the samples satisfying the embodiments of the invention can give an excellent dimensional stability and, further, only those having a grain size of from 0.1 to 0.3 μm and gamma of not lower than 6 can give excellent dimensional stability and high gamma values in both of standard process and rapid process.

EXAMPLE-5

Each of the emulsion coating solutions E-1, E-3, E-6, E-8, E-11, E-13 and E-16 of Example-1 was added with 20 mg each of Compound DS as an organic desensitizing dye, respectively. The resulted samples were named X-1, X-3, X-6, X-8, X-11, X-13 and X-16. Those samples in which Compounds DS each was replaced by 200 mg of Compound U were named Y-1, Y-3, Y-6, Y-8, Y-11, Y-13 and Y-16, respectively. Under the conditions c which are for the embodiment of the invention among the coating and drying conditions for emulsions shown in Table-8 given in Example-4, the samples each were coated and dried, so that samples X1-C through X16-C and Y1-C through Y16-C were obtained.

To the resulted samples, the same emulsion protective layers, backing layers and backing protective layers as those of Example-4 were used.

Compound DS

-continued

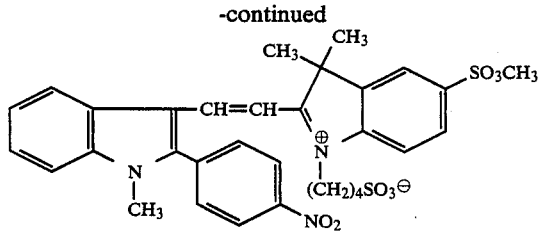

Compound U

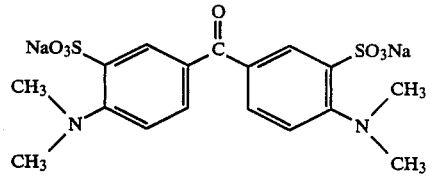

With respect to the resulted samples, the dimensional stabilities, the time required for fixing clearness and sensitometries were measured in the same manners as in Example-1, respectively. In the step of exposing them to light, the wedgewise exposures were applied thereto similarly to the case of Example-1. The combination of the contrast hardening agent and developer each containing in the samples, the fixer composition and developing conditions were the same as in Example-4.

The results thereof are shown in Table-10

TABLE 10

| Sample No. | Grain size μm | Contrast hardener | Amount added in mol/Ag mol | Developer | Standard processing: Developing conditions | Standard processing: Dimensional stability | Standard processing: Fixing clearness | Standard processing: γ | Rapid processing: Dimensional stability | Rapid processing: γ | Overall evaluation* | Invention** |
|---|---|---|---|---|---|---|---|---|---|---|---|---|
| X16-c | 0.2 | — | — | A | 28° C. 30" | +82 μm | 12" | 2.4 | +93 μm | 1.6 | N.G. | Comp. |
| X1-c | 0.2 | T | $0.4 \times 10^{-3}$ | " | " | +22 μm | 13" | 4.8 | +48 μm | 4.3 | N.G. | Comp. |
| X3-c | 0.2 | " | $4.0 \times 10^{-3}$ | " | " | +6 μm | 12" | 11.0 | +9 μm | 10.1 | G. | Inv. |
| X16-c | 0.2 | — | — | B | 38° C. 20" | +85 μm | 11" | 2.3 | +93 μm | 1.5 | N.G. | Comp. |
| X6-c | 0.2 | H | $0.4 \times 10^{-4}$ | " | " | +26 μm | 12" | 4.9 | +51 μm | 4.1 | N.G. | Comp. |
| X8-c | 0.2 | " | $4.0 \times 10^{-4}$ | " | " | +6 μm | 13" | 11.6 | +10 μm | 10.8 | G. | Inv. |
| X16-c | 0.2 | — | — | C | 34° C. 60" | +83 μm | 14" | 2.4 | +89 μm | 1.7 | N.G. | Comp. |
| X11-c | 0.2 | P | $0.1 \times 10^{-4}$ | " | " | +23 μm | 13" | 5.8 | +44 μm | 5.1 | N.G. | Comp. |
| X13-c | 0.2 | " | $1.0 \times 10^{-4}$ | " | " | +9 μm | 12" | 12.0 | +11 μm | 10.8 | G. | Inv. |
| Y16-c | 0.2 | — | — | A | 28° C. 30" | +84 μm | 12" | 2.6 | +96 μm | 1.3 | N.G. | Comp. |
| Y1-c | 0.2 | T | $0.4 \times 10^{-3}$ | " | " | +21 μm | 12" | 5.3 | +47 μm | 4.1 | N.G. | Comp. |
| Y3-c | 0.2 | " | $4.0 \times 10^{-3}$ | " | " | +7 μm | 11" | 10.8 | +10 μm | 10.2 | G. | Inv. |
| Y16-c | 0.2 | — | — | B | 38° C. 20" | +85 μm | 13" | 2.1 | +97 μm | 1.2 | N.G. | Comp. |
| Y6-c | 0.2 | H | $0.4 \times 10^{-4}$ | " | " | +26 μm | 10" | 4.8 | +51 μm | 8.0 | N.G. | Comp. |
| Y8-c | 0.2 | " | $4.0 \times 10^{-4}$ | " | " | 6 μm | 11" | 11.6 | +9 μm | 10.8 | G. | Inv. |
| Y16-c | 0.2 | — | — | C | 34° C. 60" | +80 μm | 12" | 2.4 | +86 μm | 1.9 | N.G. | Comp. |
| Y11-c | 0.2 | P | $0.1 \times 10^{-4}$ | " | " | +21 μm | 12" | 5.9 | +43 μm | 5.9 | N.G. | Comp. |
| Y13-c | 0.2 | " | $1.0 \times 10^{-4}$ | " | " | +11 μm | 12" | 11.9 | +11 μm | 11.1 | G. | Inv. |

*G. . . . Good,
N.G. . . . Not good
**Comp. . . . Comparative,
Inv. . . . Invention According to the invention, as is obvious from Examples 1 through 3, it is possible to provide a silver halide photographic light-sensitive material excellent in dimensional stability, the manufacturing process thereof and the image-forming method suitable therefor. Further, it is possible to provide a silver halide photographic light-sensitive material excellent in dimensional stability and photographic characteristics and the manufacturing process thereof even in either the standard processing or a rapid processing when making a gamma value satisfactory as in Examples 4 and 5.

What is claimed is:

1. A method for preparing a silver halide photographic light-sensitive material, which comprises a support bearing, on one side thereof, a layer containing alight-sensitive silver halide emulsion comprised of silver halide grains having an average size of from 0.05 μm to 0.3 μm and gelatin and, on the other side thereof, a non-light-sensitive layer containing gelatin, comprising a step for bringing at least one of said layer containing said emulsion and said non-light-sensitive layer into contact with air having a temperature of from 35° C. to 80° C. or a relative humidity of from 5% to 25% for a period not shorter than 5 seconds to not longer than one minute, within 5 minutes from the point of time when the average surface temperature of said layer is raised up to a temperature 1° C. lower than the average temperature of atmospheric air for drying said layer in the step where said layer is coated on said support and is cooled to be gelled and dried.

2. The method of claim 1, wherein said material is substantially contacted to atmospheric air having a dew-point of not more than 16° C. through the period a step of from completion of drying of both layers to completion of packaging of said material.

3. The method of claim 1, wherein a layer provided at least one side of said support layer contains a polymer latex in an amount of from 0.1 $g/m^2$ to 10 $g/m^2$.

4. The method of claim 3, wherein said polymer latex has an average particle size of from 0.005 μm to 1 μm.

5. The method of claim 1, wherein said material has a gamma value of not less than 6 determined between density points of 0.3 and 3.0 on a characteristic curve thereof.

6. The method of claim 5, wherein at least one of said layer containing said emulsion and a layer adjacent thereto contains a tetrazolium compound, a hydrazine compound or a polyalkylene oxide compound.

7. A method for forming images comprising a step of processing an imagewise exposed silver halide photographic light-sensitive material wherein said processing comprises steps of developing, fixing and drying and is performed for a time within the range of from 20 seconds to 60 seconds in total, and said silver halide photographic light-sensitive material comprises a support bearing, on one side thereof, a layer containing a light-sensitive silver halide emulsion comprised of silver halide grains having an average size of from 0.05 μm to 0.3 μm and gelatin and, on the other side thereof, a non-light-sensitive layer containing gelatin, and at least one of said layer containing said emulsion and said non-light-sensitive layer is brought into contact with air having a temperature of from 35° C. to 80° C. or a relative humidity of from 55% to 25% for a period not shorter than 5 seconds to not longer than one minute, within 5 minutes from the point of time when the average surface temperature of said layer is raised up to a temperature 1° C. lower than the average temperature of atmospheric are for drying said layer in the step where said layer is coated on said support and is cooled to be gelled and dried.

8. The method of claim 7, wherein said processing is performed with an automatic processing machine.

* * * * *

UNITED STATES PATENT AND TRADEMARK OFFICE

CERTIFICATE OF CORRECTION

PATENT NO. : 4,946,769

DATED : August 07, 1990

INVENTOR(S) : Takeo Arai et al.

It is certified that error appears in the above-identified patent and that said Letters Patent is hereby corrected as shown below:

Claim 7, column 64, and line 26 change "55%" to --5%--.

Signed and Sealed this

Eighth Day of September, 1992

*Attest:*

DOUGLAS B. COMER

*Attesting Officer*

*Acting Commissioner of Patents and Trademarks*